US007103307B2

(12) United States Patent
Aruga et al.

(10) Patent No.: US 7,103,307 B2
(45) Date of Patent: Sep. 5, 2006

(54) FIXING DEVICE AND IMAGE FORMING APPARATUS INCORPORATING THE SAME

(75) Inventors: Tomoe Aruga, Nagano (JP); Ken Ikuma, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 46 days.

(21) Appl. No.: 10/961,525

(22) Filed: Oct. 8, 2004

(65) Prior Publication Data

US 2005/0123328 A1 Jun. 9, 2005

(30) Foreign Application Priority Data

Oct. 8, 2003 (JP) ..... P2003-349080
Oct. 8, 2003 (JP) ..... P2003-349081
Oct. 8, 2003 (JP) ..... P2003-349082

(51) Int. Cl.
*G03G 15/20* (2006.01)

(52) U.S. Cl. ..... 399/328; 219/216; 399/329
(58) Field of Classification Search ..... 219/216; 399/68, 320, 322, 328, 329
See application file for complete search history.

(56) References Cited

U.S. PATENT DOCUMENTS 4,905,049 A * 2/1990 Bickerstaff et al. ..... 399/325
6,928,257 B1 * 8/2005 Ogiso et al. ..... 399/329

FOREIGN PATENT DOCUMENTS

JP 53-117249 9/1978
JP 02-061030 12/1992

* cited by examiner

*Primary Examiner*—Hoang Ngo
(74) *Attorney, Agent, or Firm*—Hogan & Hartson LLP

(57) ABSTRACT

In a fixing device for fixing a toner image onto a recording medium, a heating roller is provided with an elastic layer formed on an outer periphery thereof. An endless belt is adapted to be circulated. A press member presses a part of the endless belt against the heating roller so as to deform the elastic layer, thereby forming a fixing nip portion through which the recording medium it passed. A guide member has a slope portion extended so as to close to a tangential line defined at a press contact position between the heating roller and the press member, as is being away from the exit of the fixing nip portion. A fixing pressure generated at the exit of the fixing nip portion is greater than a fixing pressure generated at an entrance of the fixing nip portion.

11 Claims, 27 Drawing Sheets

FIXING DEVICE AND IMAGE FORMING APPARATUS INCORPORATING THE SAME

BACKGROUND OF THE INVENTION

The present invention relates to a fixing device comprising, a heating roller having an elastic surface layer and incorporating a heat source therein; a press roller opposed to the heating roller so as to provide pressure against the heating roller; and a heat-resistant belt circulated while being sandwiched between the heating roller and the press roller to form a fixing nip portion, wherein a sheet medium on which an unfixed toner image is formed is passed through the fixing nip portion to fix the unfixed toner image on the sheet medium.

The present invention also relates to a fixing device comprising: a heating element having a flat surface; a press roller opposed to the flat surface so as to provide pressure against the heating element; and a heat-resistant belt circulated while being sandwiched between the flat surface and the press roller to form a fixing nip portion, wherein a sheet medium on which an unfixed toner image is formed is passed through the fixing nip portion to fix the unfixed toner image on the sheet medium.

In the former type of the fixing device, when the sheet medium is passed through the fixing nip portion to perform the fixation of the unfixed toner image, the sheet medium is curled along the outer periphery of the heating roller and becomes liable to wind around the heating roller. In order to separate the sheet medium from the heating roller, there is provided a peeler such as a peeling pawl, a peeling plate at an exit side of the fixing nip portion.

For example, Japanese Patent Publication No. 2-61030B discloses a peeler in which a plurality of flexible claws are projected from a base plate toward the exit of the fixing nip portion, so as to come in slide contact with a fixing roller, in order to separate the ejected shoot medium from the fixing roller. Japanese Utility Model Publication No. 53-117249U discloses a peeler in which a plate member is formed with slits so that divided sections are made flexible. The tip ends of the divided sections are opposed to the exit of the fixing nip portion, so as to come in slide contact with a fixing roller, in order to separate the ejected sheet medium from the fixing roller.

However, in such a configuration that the peeler comes in slide contact with the fixing roller, irrespective of the degree of the sliding pressure, the surface of the fixing roller (the heating roller and/or the press roller) is liable to be subjected to damage, wear, and deterioration. In particular, such phenomenon becomes remarkable in the recent image forming apparatus in which the operation speed is increased.

Meanwhile, immediately after the fixing operation (i.e., immediately after the ejection from the fixing nip portion), the toner image is not completely fixed on the shoot medium. When the peeler disclosed in the above publications comes in slide contact with such an unfixed toner image, sliding traces would be left on the image, or the unfixed toner would be transferred onto the peeler, thereby causing a defect on the obtained image, or the unfixed image would adhere the peeler, thereby interfering the conveyance of the sheet medium and causing the sheet jamming. In particular, such phenomenon becomes remarkable in the recent image forming apparatus in which the operation speed is increased.

SUMMARY OF THE INVENTION

It is therefore an object of the invention to provide a fixing device capable of dispensing with such a peeler that forcibly peels off a sheet medium, thereby preventing the surface of a fixing member being damaged, and avoiding the defective image and the sheet jamming due to the unstable fixation of the toner image.

It is also an object of the invention to provide a fixing device in which a structure for guiding the sheet medium is simplified, thereby reducing the costs and the size of the fixing device and an image forming apparatus incorporating the fixing device.

In order to achieve the above objects, according to the invention, there is provided a fixing device for fixing a toner image onto a recording medium, comprising:

a heating roller, comprising:

a heat source; and an elastic layer, provided on an outer periphery thereof;

an endless belt, adapted to be circulated:

a press member, which presses a part of the endless belt against the heating roller so as to deform the elastic layer, thereby forming a fixing nip portion through which the recording medium is passed; and a guide member; having a slope portion extended so as to close to a tangential line defined at a press contact position between the heating roller and the press member, as is being away from the exit of the fixing nip portion, wherein a fixing pressure generated at the exit of the fixing nip portion is greater than a fixing pressure generated at an entrance of the fixing nip portion.

With this configuration, the recording medium is curled in such a direction separating from the heating roller at the exit of the fixing nip portion, so that the recording medium ejected from the fixing nip portion is conveyed without being wound on the heating roller thereby dispensing with such a peeler which forcibly peels off the recording medium. Further, since only the leading end portion of the recording medium is brought into contact with the slope portion, that is, the toner image fixed on the recording medium is not brought into contact with the guide member, the transfer or adhesion of the toner image onto the guide member can be reliably avoided.

Preferably, the slope portion is disposed in the vicinity of an exit of the fixing nip portion with a gap in between.

Preferably, the press member comprises, a press roller, opposed to the press contact position; and a belt stretcher, disposed on an upstream side in a conveyance direction of the recording sheet relative to the press roller, to stretch the belt together with the press roller while pressing a part of the belt against the heating roller to form the entrance of the fixing nip portion.

Alternatively, it is preferable that the press member comprises: an elastic member, which presses the belt against the heating roller so as to form at least the entrance of the fixing nip portion; and a separator, formed with a surface having a curvature radius which is smaller than a curvature radius of the outer periphery of the heating roller, the separator pressing the belt against the heating roller so as to form at least the exit of the fixing nip portion.

Preferably, at least a part of the press member forming the fixing nip portion is harder than the elastic layer of the heating roller.

With this configuration, the elastic layer is largely recessed at the fixing nip portion, so that the recording medium is readily curled in such a direction separating from the heating roller at the exit of the fixing nip portion.

Preferably, a PFA layer is formed on a surface of the elastic layer of the heating roller.

With this configuration, the rigidity of the heating roller is enhanced and the toner peelability from the heating roller is improved.

In this case, the diameter of the homing roller can be reduced, so that the recording medium ejected from the fixing nip portion would be more hardly to wind around the heating roller.

Preferably, the fixing pressure is continuously increased from the entrance to the exit of the fixing nip portion.

Preferably, the guide member is provided as a plate member including the slope portion.

Preferably, a plurality of ribs are provided on the slope portion so as to extend in a conveyance direction of the recording medium.

With this configuration, the contact area between the recording medium and the guide member can be minimized, so that the transfer or adhesion of tile toner image onto the guide member can be further reliably avoided.

Preferably, at leads a part of the guide member to be faced with the recording medium is coated with lubricant.

With this configuration, stress applied to the recording medium passing through the guide member ran be reduced, so that the damage on the recording medium can be avoided.

According to the invention, there is also provided an image forming apparatus, comprising;

an image forming section, which forms a toner image on a recording medium; and the above fixing device, which fixes the toner image on the recording medium.

BRIEF DESCRIPTION OF THE DRAWINGS

The above objects and advantages of the present invention will become more apparent by describing in detail preferred exemplary is embodiments thereof with reference to the accompanying drawings wherein.

DETAILED DESCRIPTION OF THE INVENTION

Embodiments of the invention will be described below in detail with reference to the accompanying drawings.

Figure 1:
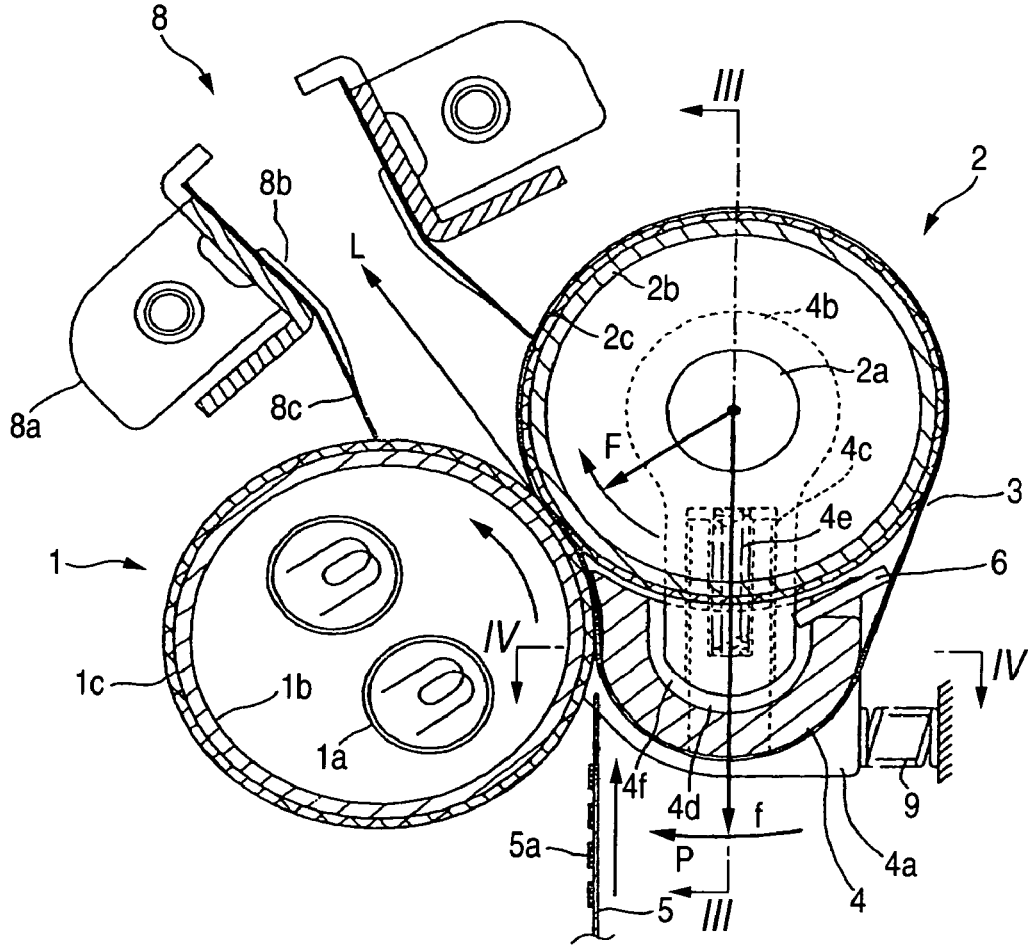
FIG. 1 is a schematic section view of a fixing device according to a first embodiment of the invention.

FIG. 1 shows a first embodiment of the invention. A heating roller 1 comprises: a tubular base 1*b* having an outer diameter of and 25 mm and a thickness of 0.7 mm; an elastic body 1*c* of a thickness of 0.4 mm covering an outer periphery of the tubular base 1*b*; and two columnar-shaped halogen lamps 1*a* of 1050 W as a heating source housed inside the tubular base 1*b*. A press roller 2 is opposed to the heating roller 1 to provide pressure against the heating roller 1. A surface of the press roller 2 is made harder than the elastic body 1*c* of the heating roller 1.

A heat-resistant belt 3 is an endless belt member suspended by the press roller 2 and a belt stretcher 4 and circulated on the outer peripheries of these members while being sandwiched between the heating roller 1 and the press roller 2 to form a fixing nip portion. The heating roller 1 and the press roller 2 are rotated in the direction of arrow in this figure to circulate the stretched belt 3. A sheet medium 5 on which an unfixed toner image 5*a* is formed is passed through the fixing nip portion, thereby fixing the unfixed toner image 5*a* on the sheet medium 5.

The thickness of the belt 3 is no less than 0.03 mm. While the belt 3 may be made of a material such as polyimide tube, heat resisting resin of silicone, etc., rubber, or the like, it is preferably a metallic bolt formed from a stainless steel base material having an excellent heat conductivity, nickel electrocast pipe, etc.

Since the surface of the press roller 2 is harder than the surface (the elastic body 1*c*) of the heating roller 1, the elastic body 1*c* is recessed at the fixing nip portion. With this configuration, the sheet medium 5 is curled in such a direction separating from the heating roller 1 at the exit of the fixing nip portion, so that the sheet medium 5 ejected from the fixing nip portion is conveyed without winding on the heating roller 1.

Specifically, the press roller 2 comprises: a tubular base 2*b* having an outer diameter equal to or less than the outer diameter of the tubular base 1*b* (e.g., 24.8 mm) and a thickness of 0.7 mm; and an elastic body 2*c* covering the outer periphery of the tubular base 2*b* and having a thickness thinner than the elastic body 1*c* (e.g., 0.2–0.3 mm) to make the surface of the press roller 2 harder than that of the heating roller 1. The elastic body 2*c* may be omitted.

Activating at least one of the halogen lamps 1*a* selectively, different heating conditions can be readily established with respect to sheet materials having different widths, for example.

The surface of the belt 3 may be formed with a rubber material such as PFA (peroxy-alkoxy-fluoro resin) and silicone, in view of influences on the surface of the opposed heating roller 1 or the toner image on the sheet medium 5 subjected to the double-sided printing.

When the heating roller 1 is heated to a predetermined temperature by the warm-up operation, the belt 3, the press roller 2, and the belt stretcher 4 are correspondingly raised to predetermined temperatures to reserve heat. When members having high coefficients of thermal conductivity ire used for the belt 3, the press roller 2, and the belt stretcher 4, heat taken at the fixing nip portion tram the belt 3 by a sheet medium 5 upon fixing of a toner image on the sheet medium 5 can be efficiently returned to the belt 3 from the press roller 2 and the belt stretcher 4, so that temperature drop of the belt 3 can be restricted especially in the case where a plurality of sheet media are successively passed to be subjected to the fixing operation.

The belt stretcher 4 is arranged on an upstream side of the conveyance direction of a sheet medium 5 relative to the fixing nip portion. The belt stretcher 4 is configured to be pivotable about a rotary shaft 2*a* of the press roller 2 in a direction indicated by an arrow P, and to stretch the belt 3 in a direction tangent to the heating roller 1 at the entrance of the fixing nip portion in order to allow the sheet medium 5 to enter the fixing nip portion smoothly, which would otherwise fold the leading end of the sheet medium 5. With this configuration, the fixing pressure provided from the press roller 2 becomes larger at the exit side of the fixing nip portion. In this case, sine the maximum fixing pressure can be applied to the sheet medium 5 at the final stage of the fixing operation, the unfixed toner image 5*a* can be reliably fixed on the sheet medium 5. In addition, since the recess of the surface of the heating roller 1 is made larger, the ejected sheet medium 5 is easily separated from the heating roller without winding thereon.

Specifically, the belt stretcher 4 is a semiannular member which stretches the belt 3 with a tension f together with the press roller 2, while bringing the belt 3 in winding contact with the heating roller 1 to form the entrance side of the fixing nip portion. The belt stretcher 4 may be made of metal such as an aluminum alloy or plastics having an excellent heat conductivity, in view of shortening a warming-up time period. It is also preferable that metallic coating treatment such as copper plating, nickel plating, deposition, or the like is applied to a surface or the plastics, thereby realizing excellent thermal responsibility with a small heat capacity.

A projecting wall 4*a* is provided on at least one widthwise end of the belt stretcher 4 to serve to restrict offset by causing the belt 3 to abut against the projecting wall 4*a* in the case where the belt becomes offset. The belt stretcher 4 is urged against the heating roller 1 by a spring 9 disposed at a face of the projecting wall 4*a* which is opposite to the heating roller 1.

In order to stably circulating the belt 3, a friction efficient between the press roller 2 and the belt 3 is preferably set to be larger than that between the belt stretcher 4 and the belt 3. However, such friction coefficients become in some cases unstable due to entry of foreign matters, wear, or the like. To cope with this, by setting a winding angle of the belt 3 (circumferential angle over which the belt 3 comes in contact with) around belt stretcher 4 to be smaller than that of the belt 3 around the press roller 2, and by setting a curvature radius of the belt stretcher 4 to be smaller than that of the press roller 2, a distance, over which the belt 3 slides on the belt stretcher 4, is shortened, so that it is possible to avoid the unstable factor with respect to the stable circulation of the belt 3.

A cleaner 6 is arranged between the press roller 2 and the belt stretcher 4 so as to come in slide contact with an inner peripheral surface of the belt 3 to remove foreign matters, abrasion, powder, etc. therefrom, to remove such an unstable factor. A recess 4*f* provided in the belt stretcher 4 is suitably used to accommodate the removed foreign matters.

The sheet medium 5 passing through the fixing nip portion is conveyed in a direction L which is equivalent to the tangential line at the press contact position between the heating roller 1 and the press roller 2.

A guide member 8 serves to guide the conveyance direction of the sheet medium 5 ejected from the fixing nip portion. The guide member 8 is retained on a main frame of the image forming apparatus by way of retainers 8*a*, such that a front end of a guide plate 8*a* is disposed in the vicinity of the exit of the fixing nip portion without coming in slide contact with the belt 3 and the heating roller 1. In other words, a gap is provided between the front end of the guide plate 8*b* and both of the belt 3 and the heating roller 1.

Specifically, the guide plate 8*b* is made of heat-resistant resin such as polyimide, polyamide imide, PPS, etc., or metallic sheet such as stainless steel sheet, phosphor bronze sheet, thin steel sheet, etc. The guide plate 8*b* comprises a guide slope 8*c* which closes to the tangential line L as is separated from the exit of the fixing nip portion. The extending direction of the guide slope 8*c* is determined such that a front end thereof is directed in a range between a rotary center of the heating roller 1 and the fixing nip portion. In other words, the front end of the guide slope 8*a* is directed in such a direction not crossing the tangential line L.

In a case where the front end of the guide slope 8*c* is directed in such a direction crossing the tangential line L, the front end of the guide slope 8*c* will come in slide contract with the toner image on the ejected sheet medium, as in the related-art configurations. On the other hand, in a case where the front end of the guide slope 8*c* is directed in such a direction too far from the tangential line L, the ejected sheet medium would be liable to wind around the heating roller 1.

In this embodiment, since the outer diameters of the heating roller 1 and the press roller 2 are made relatively small (e.g., 25 mm), the sheet medium 5 ejected from the fixing nip portion would be hardly wound around the heating roller 1 or the belt 3, thereby dispensing with such a peeler which forcibly peels oft the sheet medium 5.

The degree of curling given to the sheet medium 5 passing through the fixing nip portion may be easily controlled by adjusting the difference between the surface hardnesses of the heating roller 1 and the press roller 2, and the pressure provided from the press roller 2. A PFA (peroxy-alkoxy-fluoro resin) layer of about 30 μm may be provided on the surface of the elastic body 1*c*, thereby enhancing the rigidity thereof and improving the toner peelability from the heating roller 1.

By appropriately selecting the extending direction of the guide slope 8*c*, the sheet medium 5 ejected from the fixing nip portion is guided to the proper direction while only the leading end of the sheet medium 5 is brought into slide contact with the guide plate 8*b*. Accordingly, a toner image on the sheet medium 5 does not contact slidingly with the guide plate 8*b*, any sliding trace is not left on the fixed toner image, or a fixed toner image is not transferred to the guide plate 8*b* to cause a defect in an image, and a fixed toner image is not adhered to the guide plate 8*b* to hinder ejection of the sheet medium which would otherwise cause the sheet jamming.

Figure 2A:
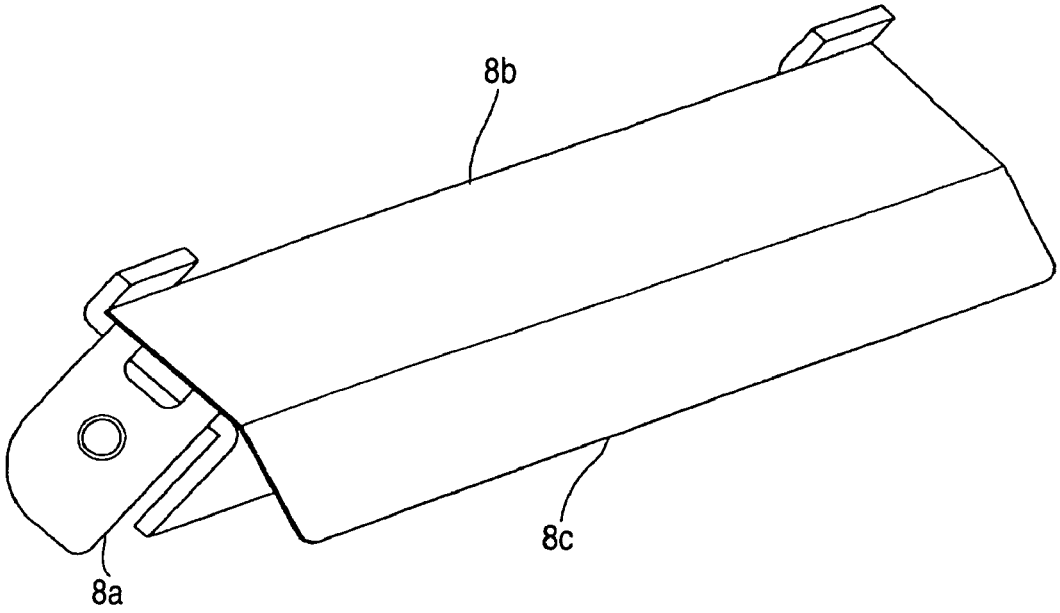
FIG. 2A is perspective view of a guide member in the fixing device of FIG. 1.
Figure 2B:
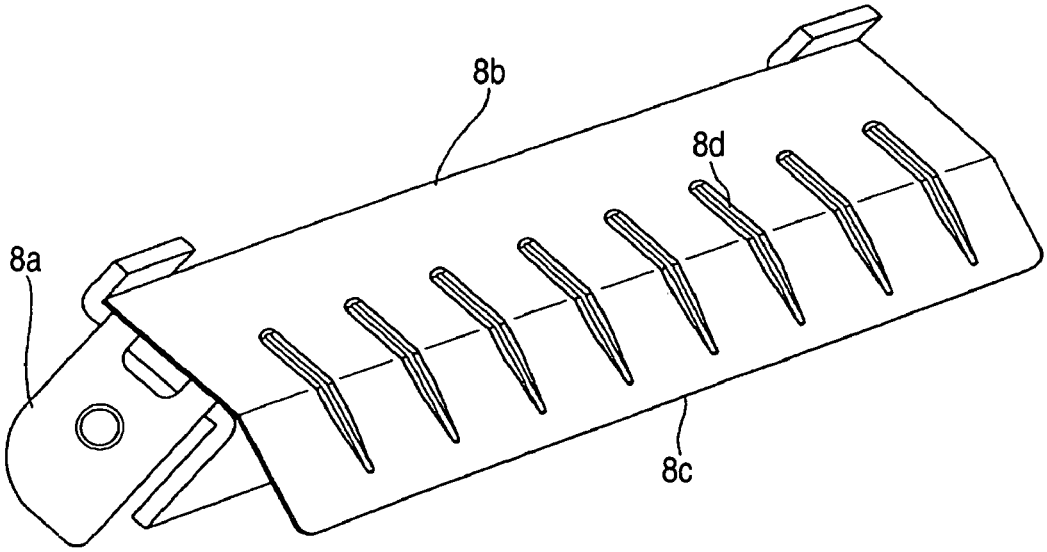
FIG. 2B is a perspective view of a modified example of the guide member of FIG. 2A.

As shown in FIG. 2A, the retainers 2*a* are provided on both widthwise ends of the guide member 8. As shown in FIG. 2B, the guide plate 8*b* may be formed with a plurality of ribs 8*d* extending in the conveyance direction of the sheet medium 5.

Lubricant treatment such as coating of a fluorine base material, paint application, plating treatment, etc. may be applied on at least surfaces of the guide member 8 opposed to the sheet medium 5, thereby reducing the slide resistance of the sheet medium conveyance. Even if a part of the toner image on the street medium 5 adheres onto the guide member 8, such toner will be easily peeled off.

Figure 3:
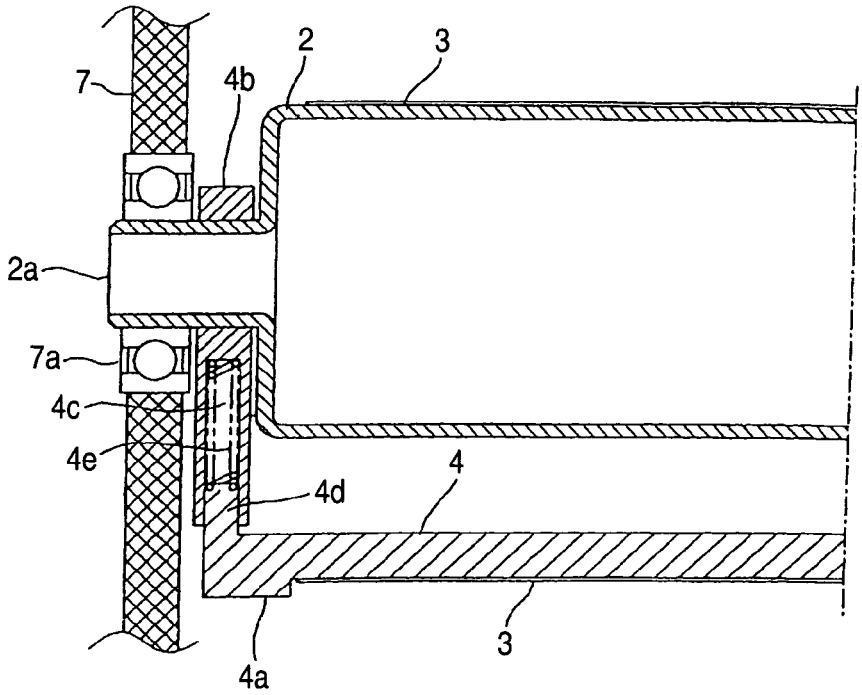
FIG. 3 is a section view taken along a line III—III in FIG. 1.

Next, supporting structure for the press roller 2 and the belt stretcher 4 will be described with reference to FIG. 3. The right side of the device is omitted.

The rotary shafts 2*a* at both ends 6*t* the press roller 2 are rotatably supported on side frames 7 by way of bearings 7*a*. A pivot arm 4*b* is pivotably fitted with each of the rotary shafts 2*a*. The pivot arm 4*b* is formed with a guide groove 4*c*. Each of the both widthwise ends of the belt stretcher 4 is formed with a guide portion 4*d*. The guide portion 4*d* is fitted into the guide groove 4*c* together with a spring 4*e* With this configuration, the bolt stretcher 4 is urged by the spring 4*e* in a direction away from the press roller 2, thereby applying the tension f to the belt 3.

Since the belt stretcher 4 is not rotated with the circulation of the belt 3, it is not necessary to provide a bearing member, thereby the supporting structure can be simplified. Further, since the belt stretcher 4 is shaped into semiannular, the distance between the press roller 2 and the belt stretcher 4 can be reduced as much as possible, thereby shortening the entire length of the belt 3, and reducing the entire size of the fixing device. As a result, not only the warming-up time period until the temperature of the belt 3 reach the predetermined value can be shortened, but also the thermal loss during the circulation of the belt 3 can be reduced.

Since the belt stretcher 4 brings the belt 3 into contact with the heating roller 1 as explained the above, the entire length of the fixing nip portion can be elongated. It is advantageous that heat sufficient for fixing the unfixed toner image 5*a* can be easily secured without largely recessing the surface of the heating roller 1, which would otherwise give stress to the sheet medium 5 passing through the fixing nip portion. As a result, deformation such as wrinkles on the sheet medium 5 can be suppressed.

Figure 4:
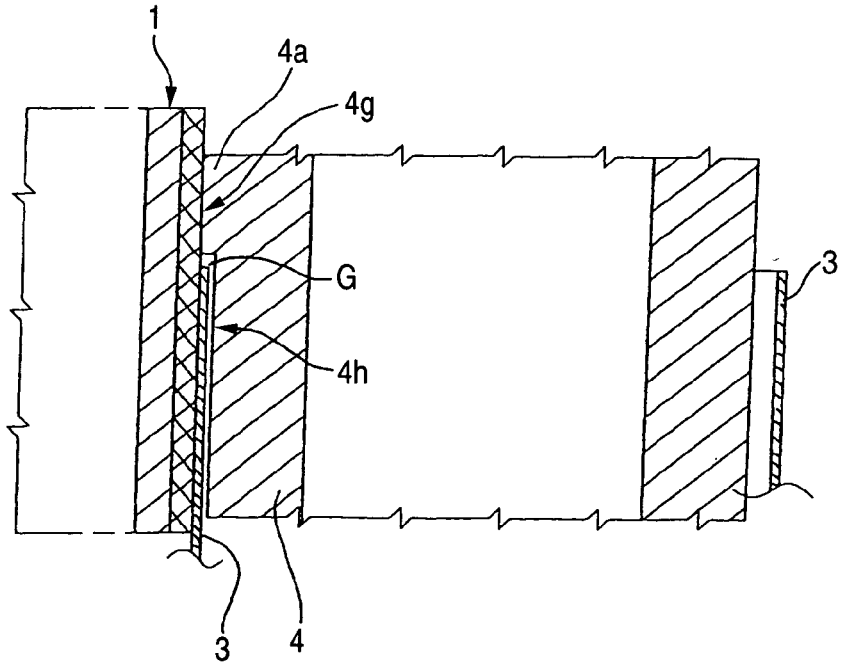
FIG. 4 is a section view taken along a line IV—IV in FIG. 1.
Figure 5:
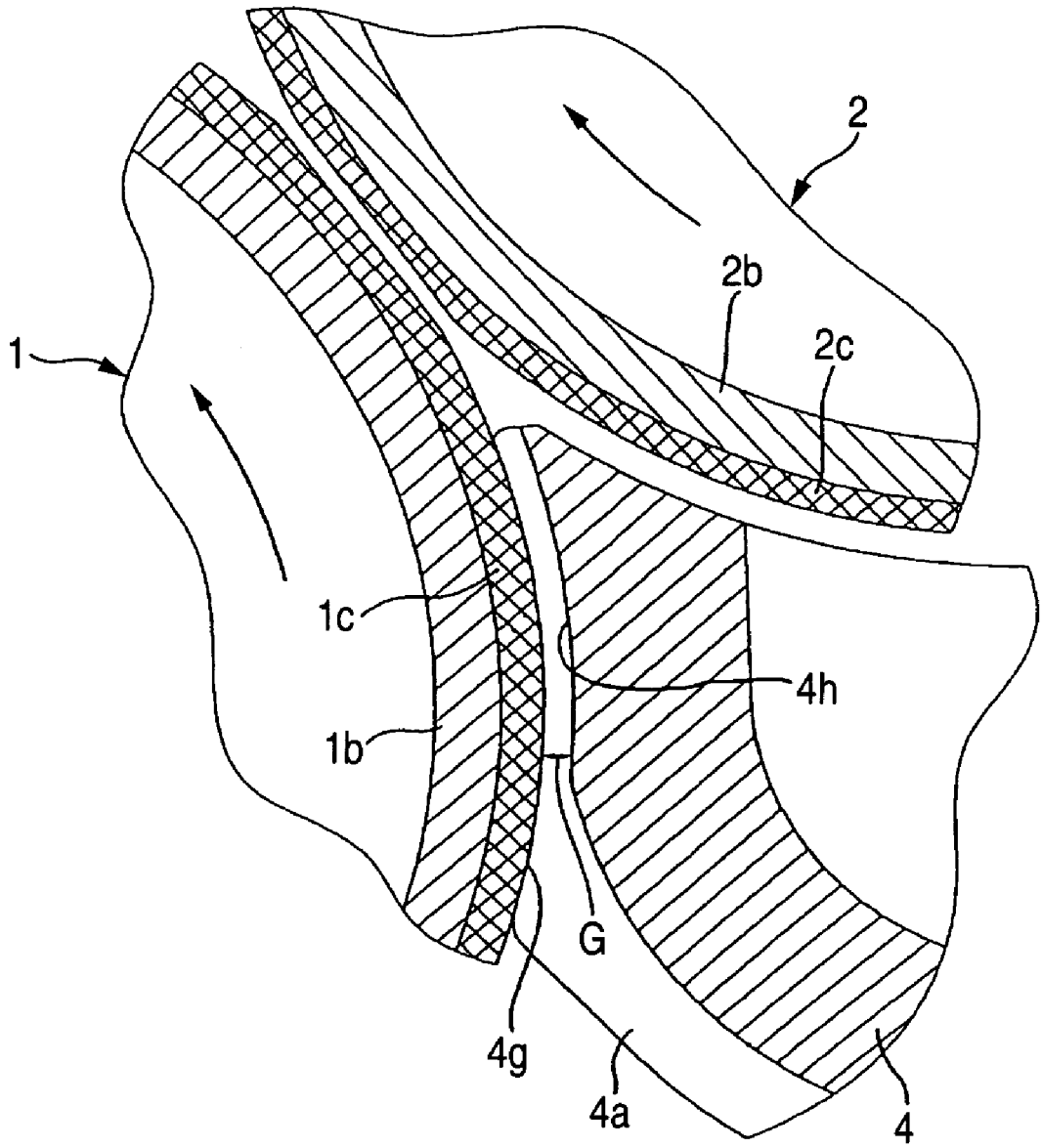
FIG. 5 is an enlarged section view of an entrance of a fixing nip portion in the fixing device of FIG. 1, showing a state that a belt is omitted.

As shown in FIGS. 4 and 5, the position of the belt stretcher 4 is determined by bringing a face 4*g* of the projecting wall 4*a* into slide contact with the heating roller 1. A pressing face 4*h* of the belt stretcher 4 is recessed from the face 4*g* so as to define a gap G which is greater than the thickness of the belt 3, and so as to be concentric with the heating roller 1. The pressing face 4*h* serves to press the belt 3 against the heating roller 1 during the circulation of the belt 3. For example, the gap G is configured to be 110 μm, while the thickness of the belt 3 is configured to be 80 μm, so that stable fixing operation can be performed even for a sheet medium having a thickness of 60 μm.

Figure 6:
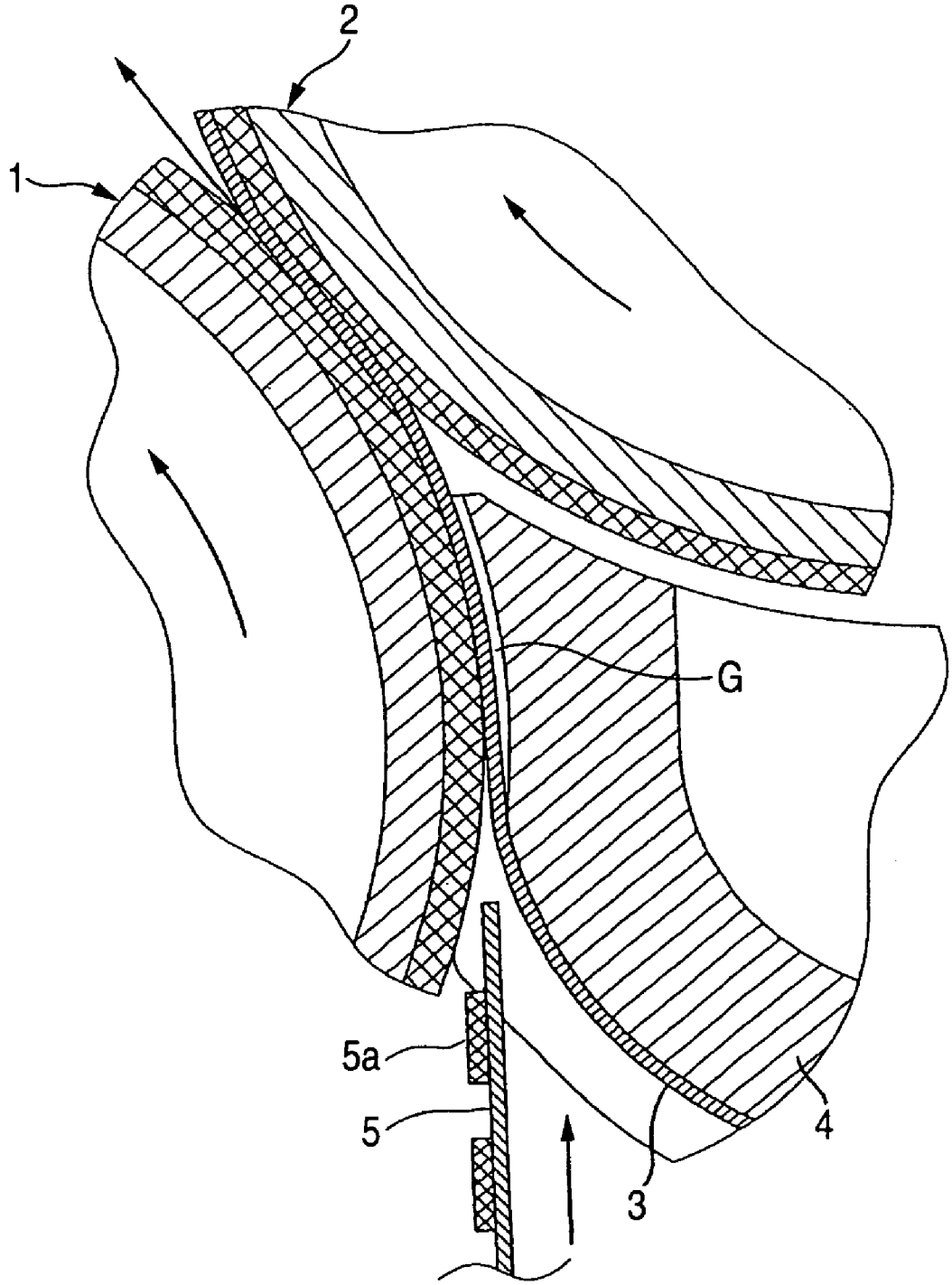
FIG. 6 is an enlarged section view of the entrance of the fixing nip portion, showing a state before a sheet medium enters the fixing nip portion.

As shown in FIG. 6, since the belt 3 is pressed against the heating roller at the entrance of the fixing nip portion, the circumferential velocities of the heating roller 1 and the belt 3 can be made coincident with each other, thereby stabilizing the initial condition of the fixing operation.

Further, in a condition before the sheet medium 5 enters the fixing nip portion, a gap G is provided between the belt 3 and the belt stretcher 4, the heat loss from the belt 3 to the belt stretcher 4 can be reduced because the gap G serves as a thermal insulation layer, thereby shortening a time period required for warming up the fixing device.

Figure 7:
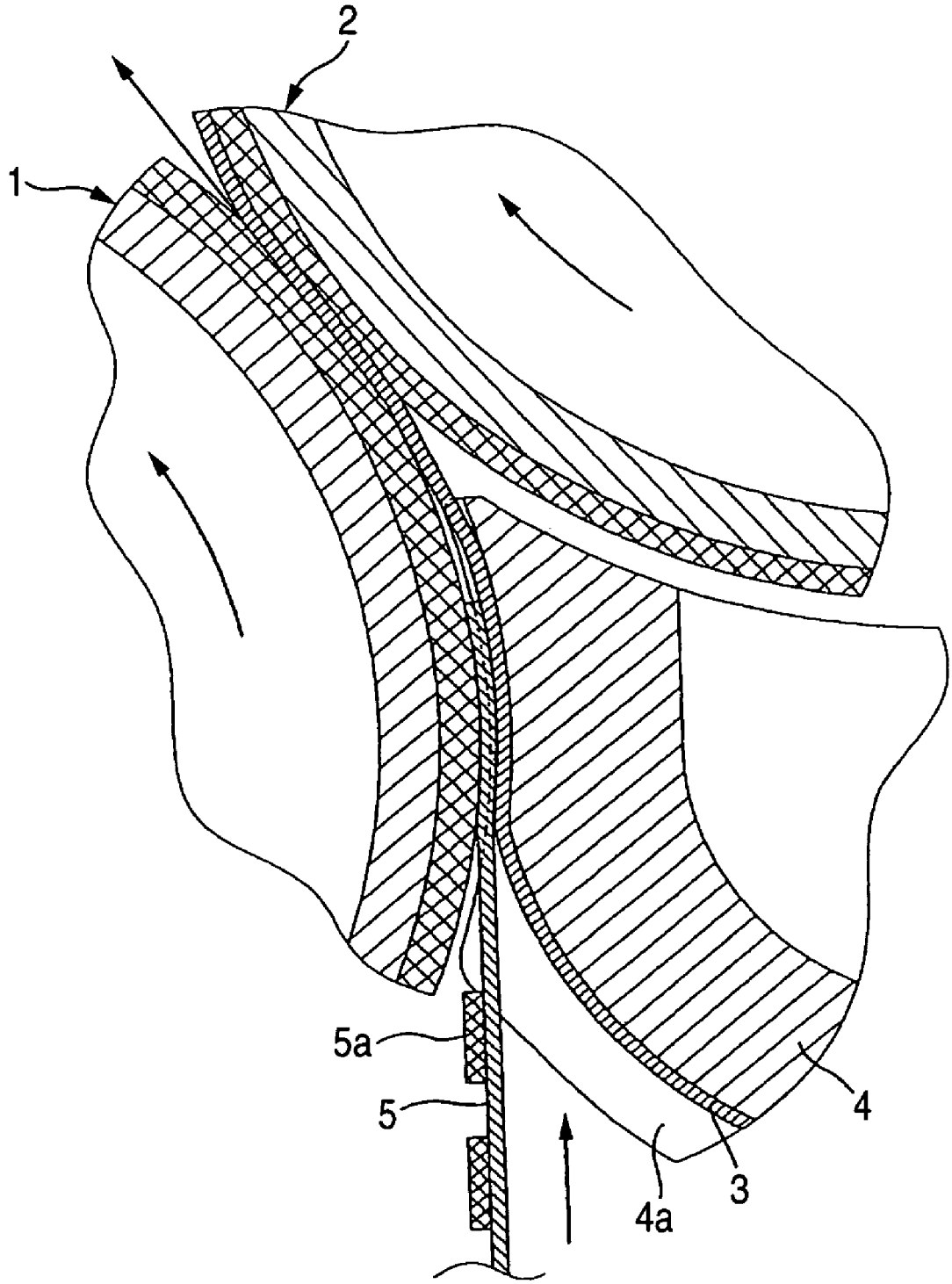
FIG. 7 is an enlarged section view of the entrance of the fixing nip portion, showing a state that the sheet medium enters the fixing nip portion.

When the sheet medium 5 enters the fixing nip portion as shown in FIG. 7, the projecting wall 4*a* of the belt stretcher 4 is separated from the heating roller 1, and the gap G between the belt 3 and the belt stretcher 4 is eliminated. The sheet medium 5 is held between the heating roller 1 and the belt 3. Appropriately determining the urging force or the spring 9, the holding force can be adjusted to establish a proper fixing condition.

Since the heat quantity transferred from the heat roller 1 to the belt stretcher 4 is made small because of the gap G, A surface of the sheet medium 5 facing the belt 3 will not be heated so much. Accordingly, in a case where the surface of the sheet medium 5 on which the fixed toner image is formed enters again the fixing nip portion and opposes to the belt 3 when the double-sided printing is performed, the fixed toner image will not be heated excessively which would otherwise provide damage on the fixed toner image.

When the belt 3 is circulated by rotating one of the heating roller 1 and the press roller 2, the belt stretcher 4 is pivoted toward the heating roller 1 by the driving force of the rollers and the sliding friction force generated between the belt 3 and the belt stretcher 4. The spring 9 urges the belt stretcher 4 so as to assist the above pivotal movement, thereby stabilizing the fixing pressure provided from the belt stretcher 4 against the heating roller 1.

Figure 8A:
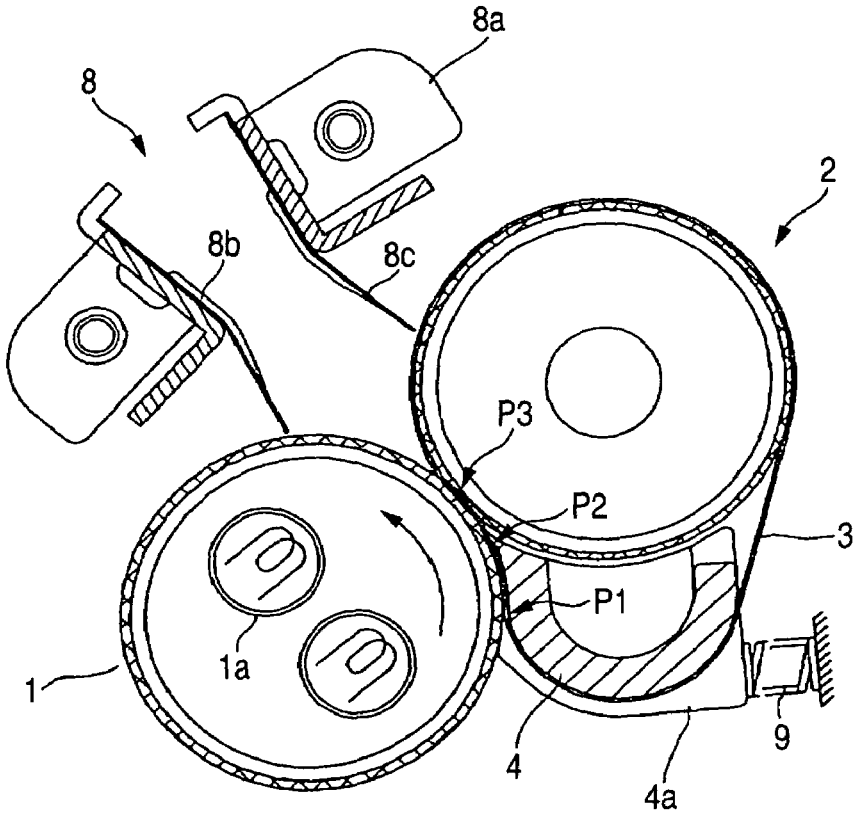
FIGS. 8A and 8B are views for explaining fixing pressure distribution in the fixing nip position.
Figure 8B:
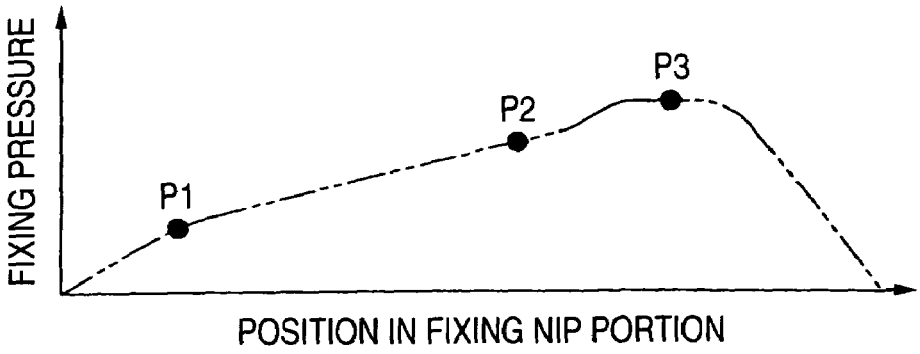

In this embodiment, since the spring 9 is disposed on the upstream side in the circulating direction of the belt 3 relative to the press contact position between the heating roller 1 and the press roller 2 (i.e., disposed at a position away from the pivotal center of the belt stretcher 4), according to the leverage principle, the fixing pressure is continuously increased from the entrance of the fixing nip portion toward the press contact position between the heating roller 1 and the press roller 2, as shown in FIG. 8B. Since the stress varying stepwise will not be applied to the sheet medium 5 passing through the fixing nip portion, not only the uneven fixing but also the deformation of the sheet medium such as wrinkles can be avoided.

Specifically, as shown in FIG. 8A, assuming that the fixing pressure at the entrance of the fixing nip portion is P1, the fixing pressure at the press contact position between the heating roller 1 and the press roller 2 is P3, and the fixing pressure at an intermediate position between the entrance and the press contact position is P3, the relationship P1<P2<P3 is established. Here, P3 is the maximum value. Since the highest pressure is applied to the sheet medium at the final stage of the fixing operation (i.e., after the toner fusing stage), the surface on which fused toner is provided can be made smooth and the permeation of the fused toner into the sheet medium can be promoted, thereby stabilizing the fixed image. It is especially advantageous for a sheet medium having a highly smooth surface and high airtightness, such as an OHP sheet.

Figure 9A:
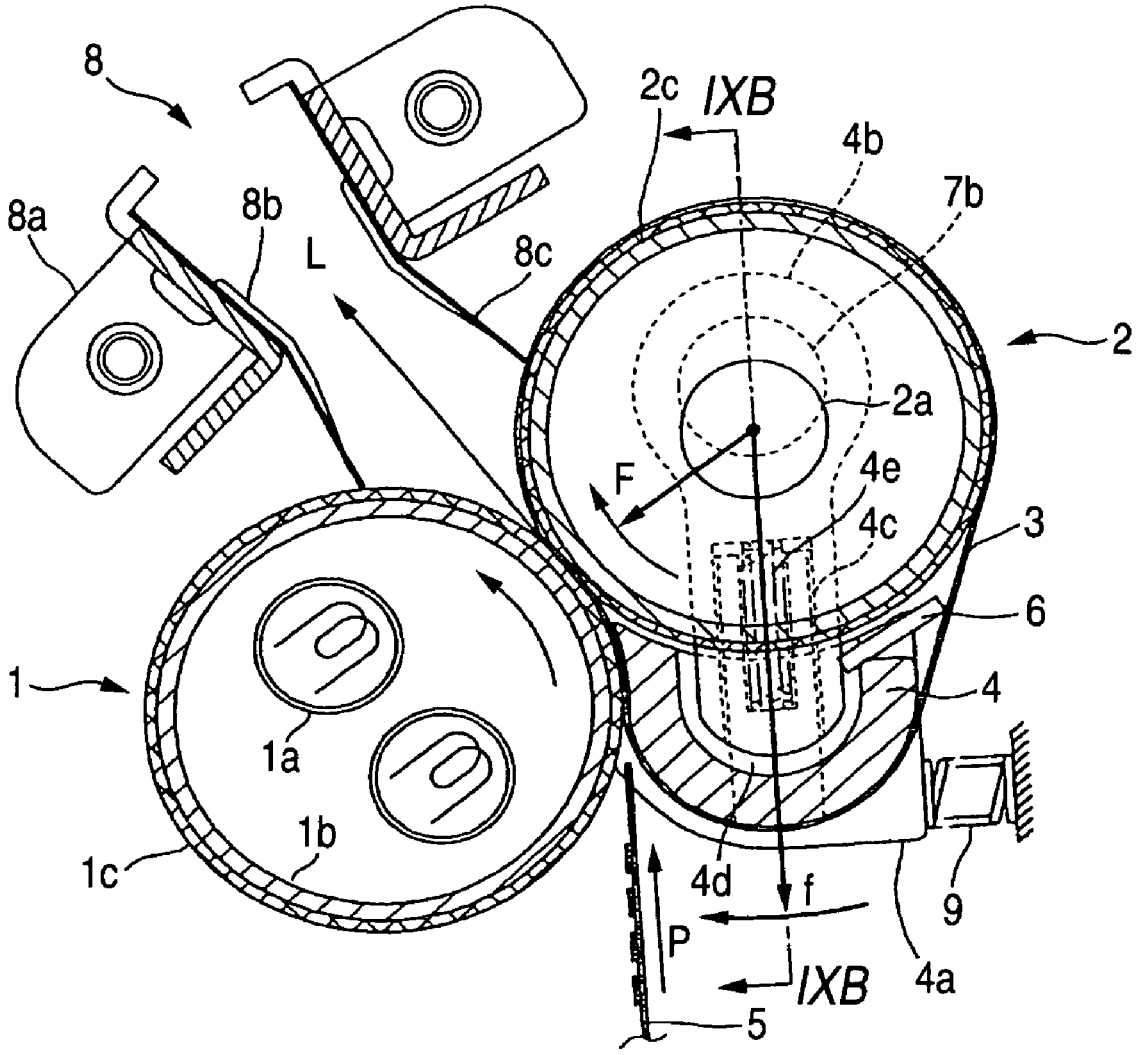
FIG. 9A is a schematic section view of a fixing device according to a second embodiment of the invention.
Figure 9B:
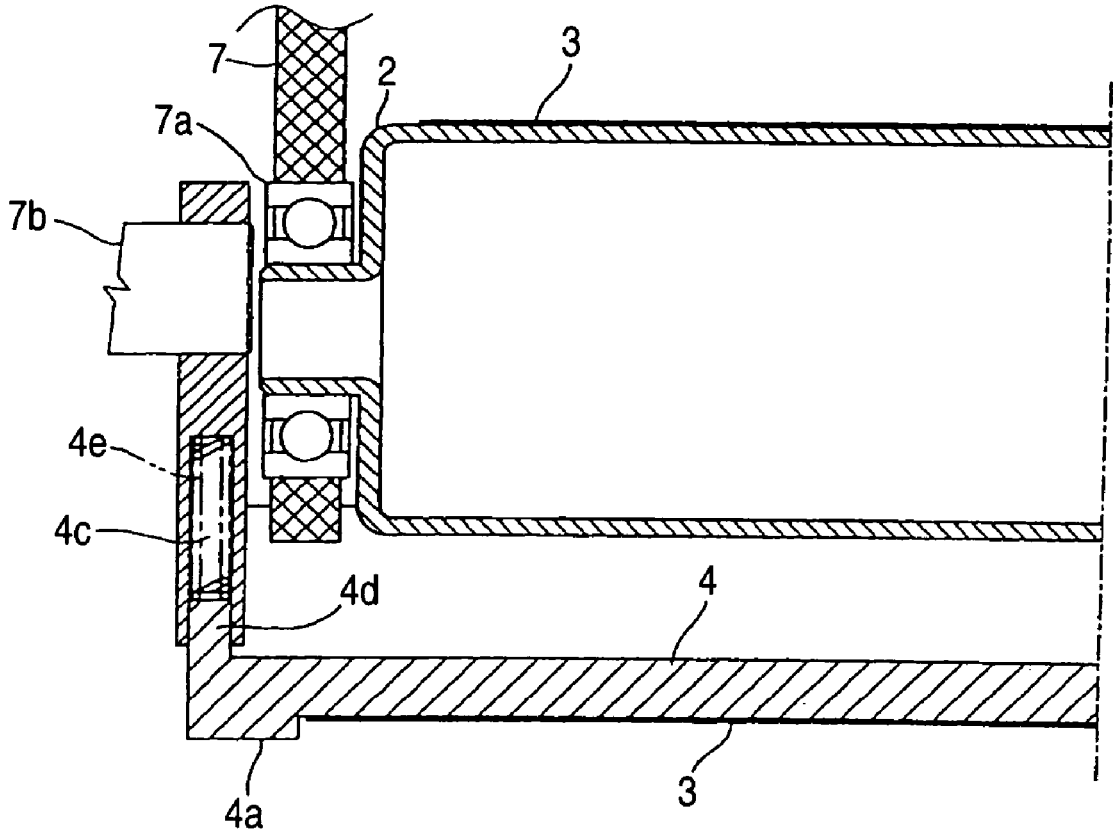
FIG. 9B is a section view taken along a line IXB—IXB in FIG. 9A.

FIGS. 9A and 9B show a second embodiment of the invention. Elements similar to those in the first embodiment will be designated by the same reference numerals and the repetitive explanations for those will be omitted.

In this embodiment the belt stretcher 4 is pivotably supported on a shaft 7*b* which is different from the rotary shaft 2*a* of the press roller 2. Specifically, the pivot arm 4*b* of the belt stretcher 4 is pivotably fitted with the shaft 7*b* placed at a different position from the rotary shaft 2*a*.

With this configuration, it is possible to change an angular moment acting on tile belt stretcher 4 (an angular moment is increased in this embodiment in comparison with the first embodiment) and to adjust a pressure provided from the belt 3 against the heating roller 1.

Figure 10:
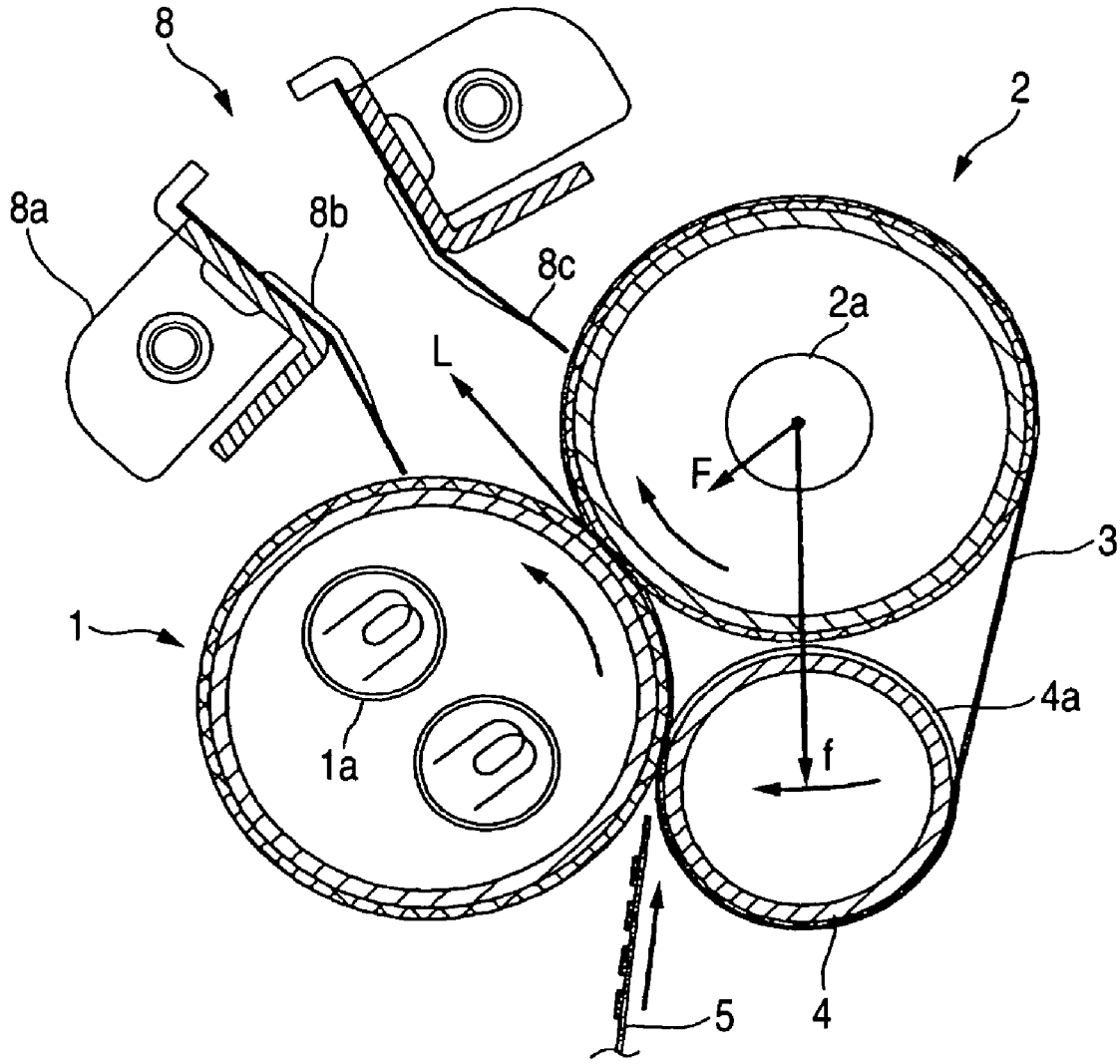
FIG. 10 is a schematic section view of a fixing device according to a third embodiment of the invention.

FIG. 10 shows a third embodiment of the invention. Elements similar to those in the first embodiment will be designated by the same reference numerals and the repetitive explanations for those will be omitted.

Figure 11A:
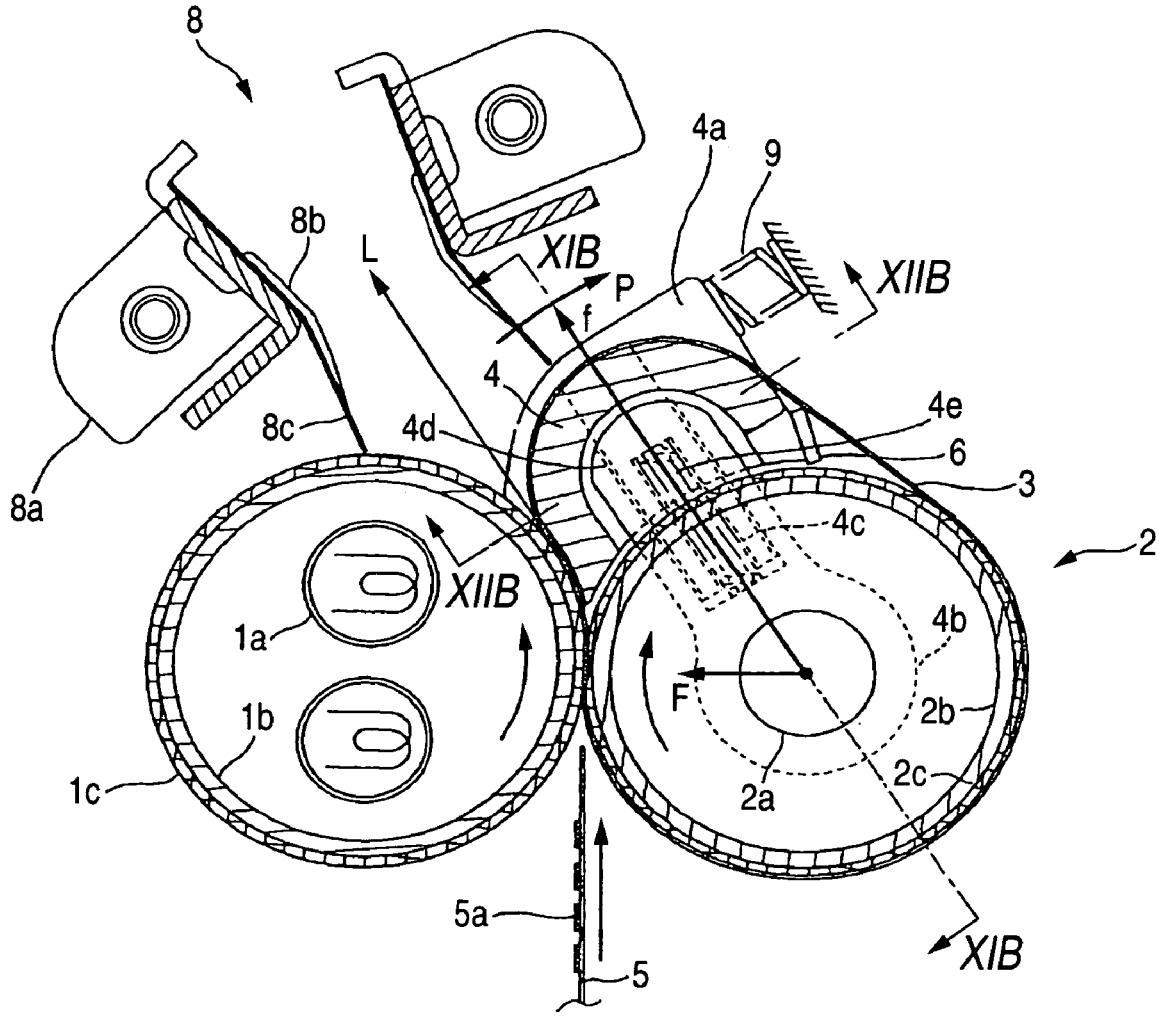
FIG. 11A is a schematic section view of a fixing device according to a fourth embodiment of the invention.
Figure 11B:
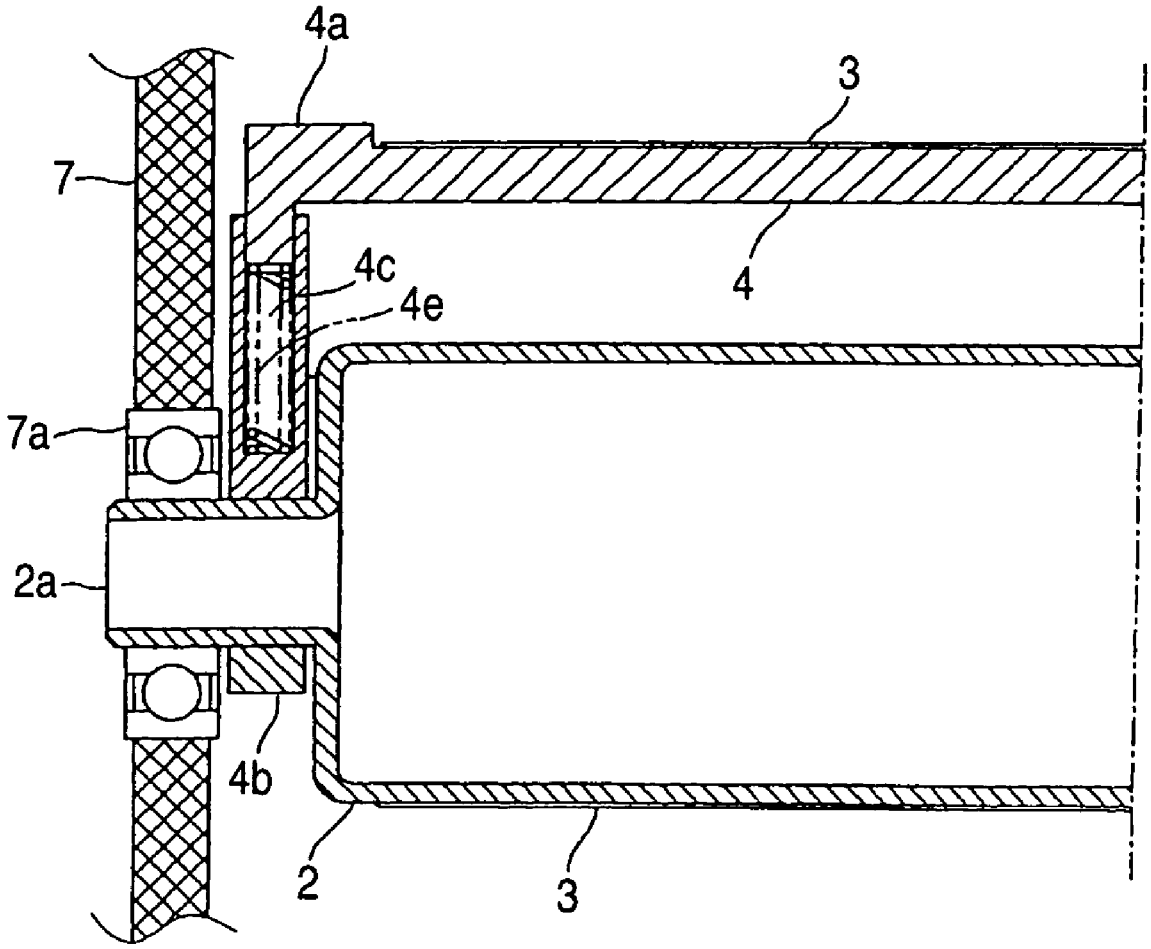
FIG. 11B is a section view taken along a line XIB—XIB in FIG. 11A.

In this embodiment, the belt stretcher 4 is provided as a non-rotatable cylindrical member, FIGS. 11A and 11B show a fourth embodiment of the invention. Elements similar to those in the first embodiment will be designated by the same reference numerals and the repetitive explanations for those will be omitted.

In this embodiment, the belt stretcher 4 is disposed on the downstream side in the conveyance direction of the sheet medium 5 relative to the press contact position between the heating roller 1 and the press roller 2. The belt stretcher 4 is configured to be pivotable about the rotary shaft 2*a* of the press roller 2 in a direction indicated by an arrow P, and to stretch the belt 3 in a direction tangent to the heating roller 1 at the exit of the fixing nip portion in order to allow the sheet medium 5 to eject the fixing nip portion smoothly. The belt stretcher 1 is a semiannular member which stretches the belt 3 with a tension f together with the press roller 2, while bringing the belt 3 in winding contact with the heating roller 1 to form the exit side of the fixing nip portion.

Figure 12A:
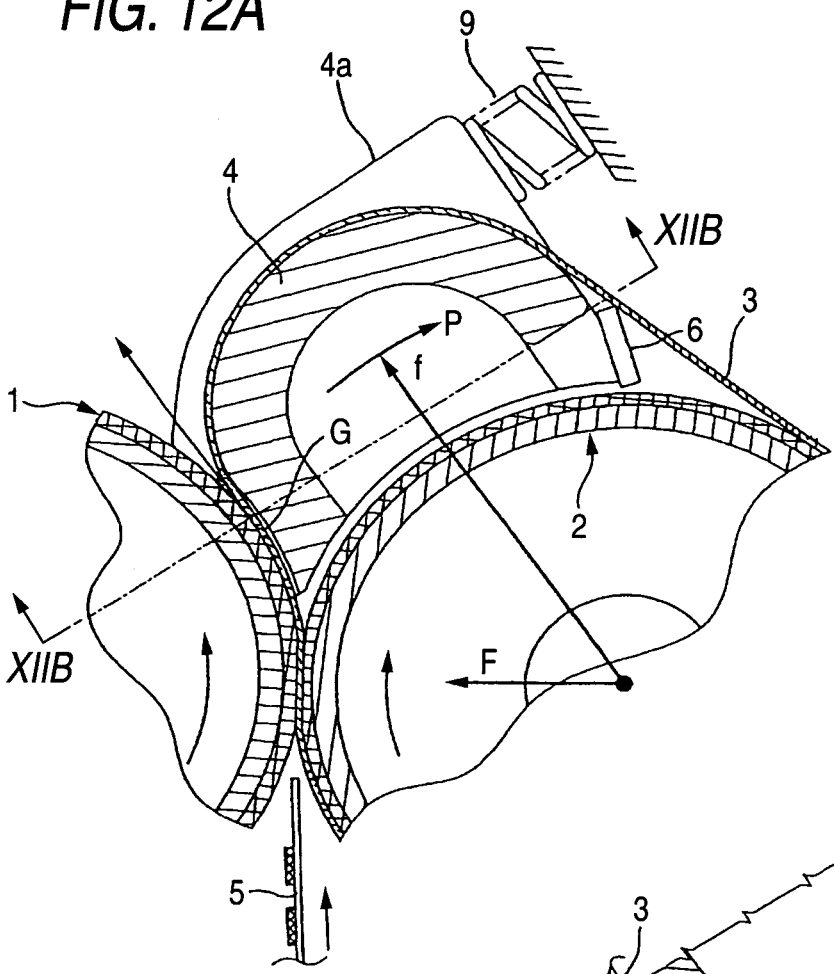
FIG. 12A is an enlarged section view of the exit of a fixing nip portion in the taxing device of FIG. 11A, showing a state before a sheet medium enters the fixing nip portion.
Figure 12B:
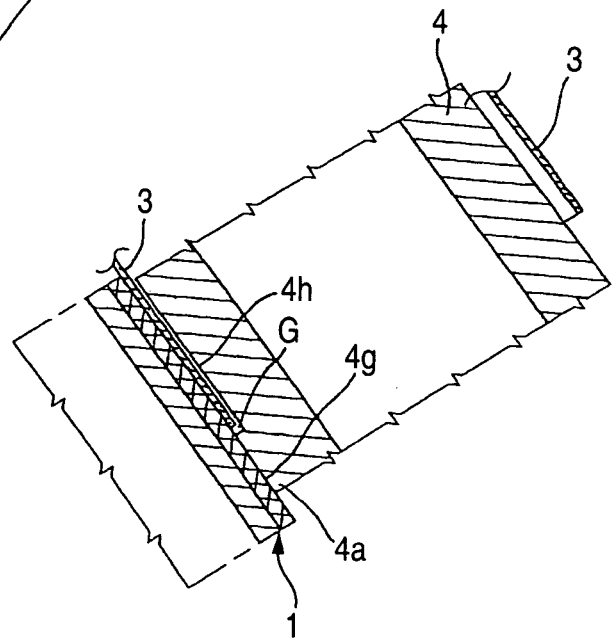
FIG. 12B is a section view taken along a line XIIB—XIIB in FIG. 12A.

As shown in FIGS. 12A and 12B, the position of the belt stretcher 4 determined by bringing a face 4*g* of the projecting wall 4*a* into slide contact with the heating roller 1. A pressing face 4*h* of the belt stretcher 4 is recessed from the face 4*g* so as to define a gap G which is greater than the thickness of the belt 3, and so as to be concentric with the heating roller 1. The pressing face 4*h* serves to press the belt 3 against the heating roller 1 during the circulation of the belt 3. For example, the gap G is configured to be 110 μm, while the thickness of the belt 3 is configured to be 80 μm so that stable fixing operation can be performed even for a sheet medium having a thickness of 60 μm.

Further, in a condition before the sheet medium b enters the fixing nip portion, a gap G is provided between the belt 3 and the belt stretcher 4, the heat loss from the belt 3 to the belt stretcher 4 can be reduced because the gap G serves as a thermal insulation layer, thereby shortening a time period required for warming up the fixing device.

Figure 13A:
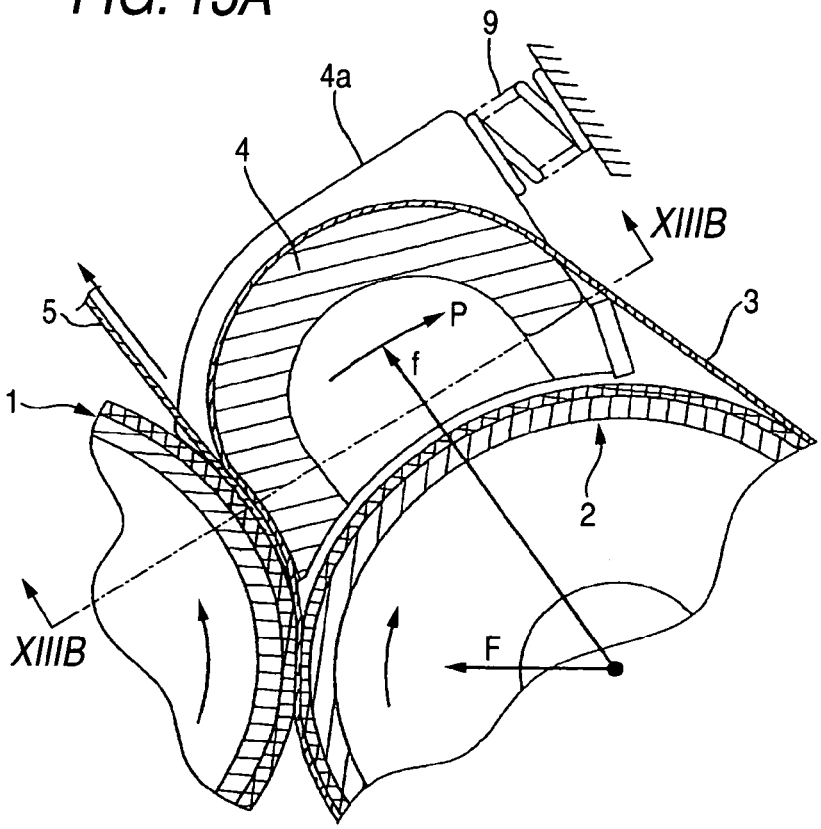
FIG. 13A is an enlarged section view of the exit of the fixing nip portion in the fixing device of FIG. 11A, showing A state that the sheet, medium enters the fixing nip portion.
Figure 13B:
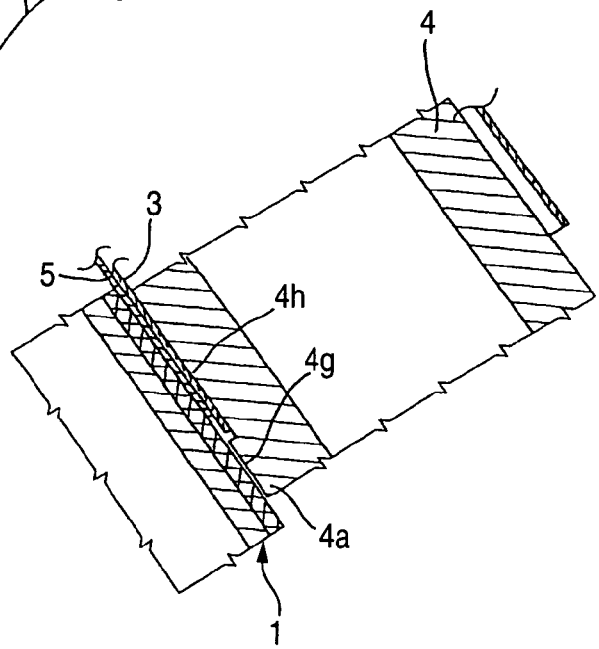
FIG. 13B is a section view taken along a line XIIIB—XIIIB in FIG. 13A.

When the sheet medium 5 enters the fixing nip portion as shown in FIGS. 13A and 13B, the projecting wall 4*a* of the belt stretcher 4 is separated from the heating roller 1, and the gap G between the belt 3 and the belt stretcher 4 is eliminated. The sheet medium 5 is held between the heating roller 1 and the belt 3. Appropriately determining the urging force of the spring 9, the holding force can be adjusted to establish a proper fixing condition.

When the belt 3 is circulated by rotating one of the heating roller 1 and the press roller 2. The belt stretcher 4 is pivoted away from the heating roller 1 by the driving force of the rollers and the sliding friction force generated between the belt 3 and the belt stretcher 4. The spring 9 urges the belt stretcher 4 against the above pivotal movement, thereby stabilizing the fixing pressure provided from the belt stretcher 4 against the heating roller 1.

Figure 14A:
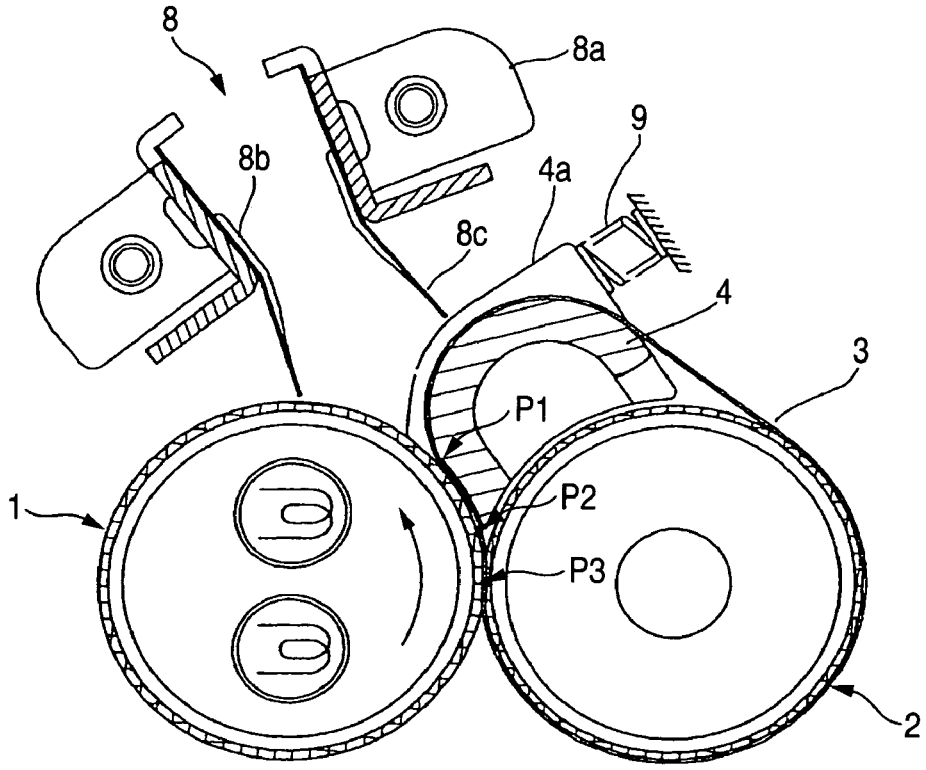
FIGS. 14A and 14B are views for explaining fixing pressure distribution in the fixing nip position in the fixing device of FIG. 11A.
Figure 14B:
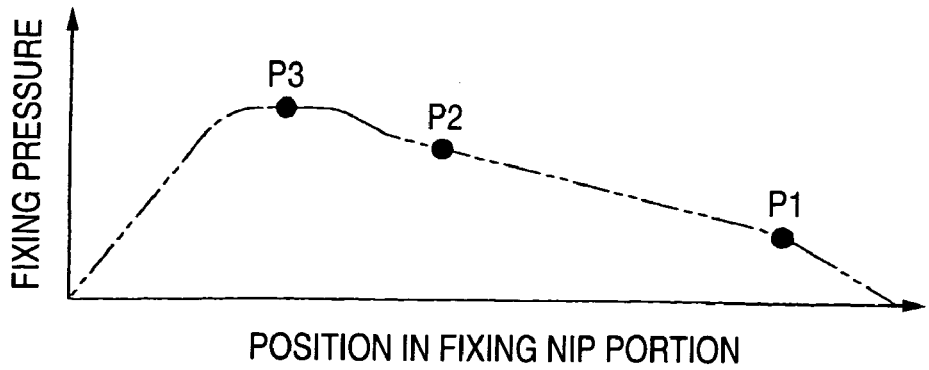

In this embodiment, since the spring 9 is disposed on the downstream side in the circulating direction of the belt 3 relative to the press contact position between the heating roller 1 and the press roller 2 (i.e., disposed at a position away from the pivotal center of the bolt stretcher 4), according to the leverage principle, the fixing pressure is continuously decreased from the entrance of the fixing nip portion toward the press contact position between the hooting roller 1 and the press roller 2, as shown in FIG. 14B. Since the stress varying stepwise will not be applied to the sheet medium 5 passing through the fixing nip portion, not only the uneven fixing but also the deformation of the sheet medium such as wrinkles can be avoided.

Specifically, as shown in FIG. 14A, assuming that the fixing pressure at the exit of the fixing nip portion is P1, the fixing pressure at the press contact position between the heating roller 1 and the press roller 2 is P3, and the fixing pressure at an intermediate position between the entrance and the press contact position is P3, the relationship P1<P2<P3 is established. Here, P3 is the maximum value.

Figure 15A:
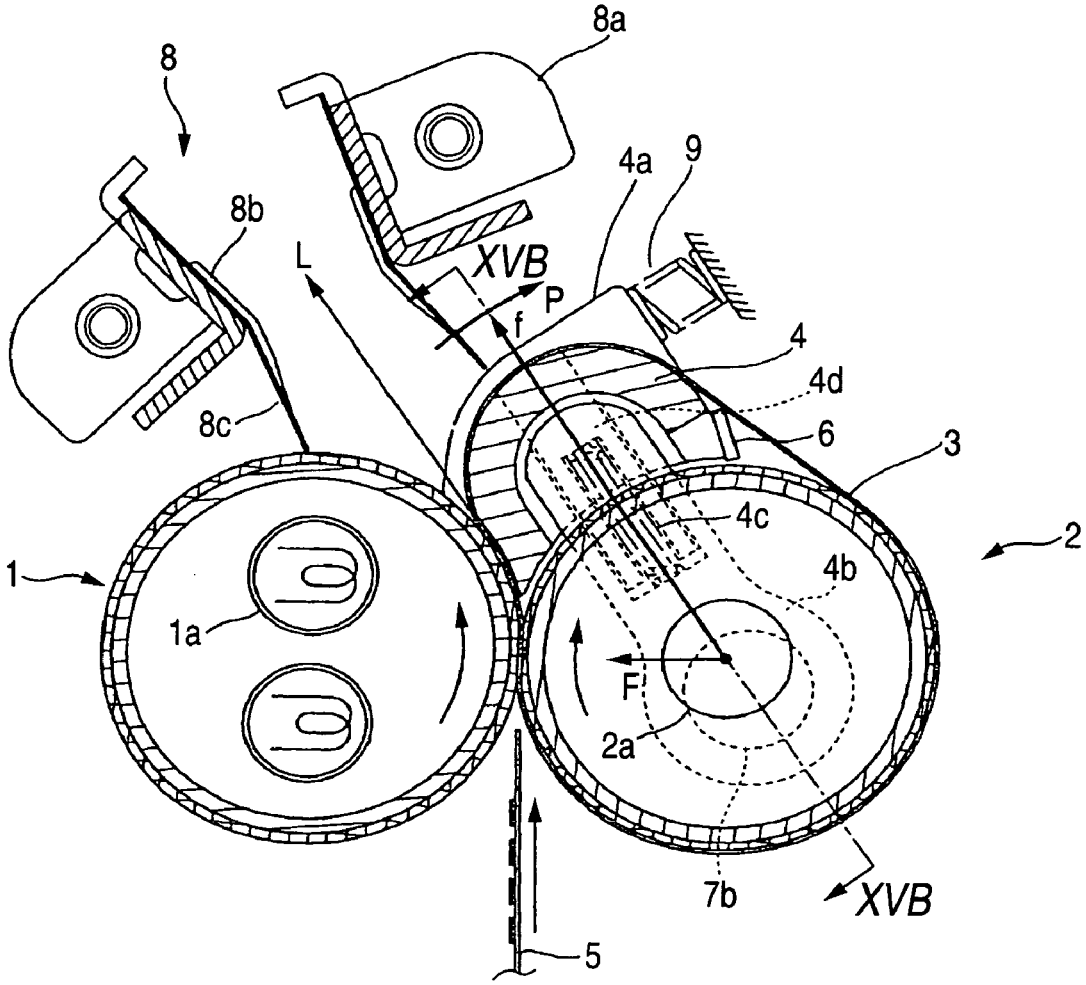
FIG. 15A is a schematic section view of a fixing device according to a fifth embodiment of the invention.
Figure 15B:
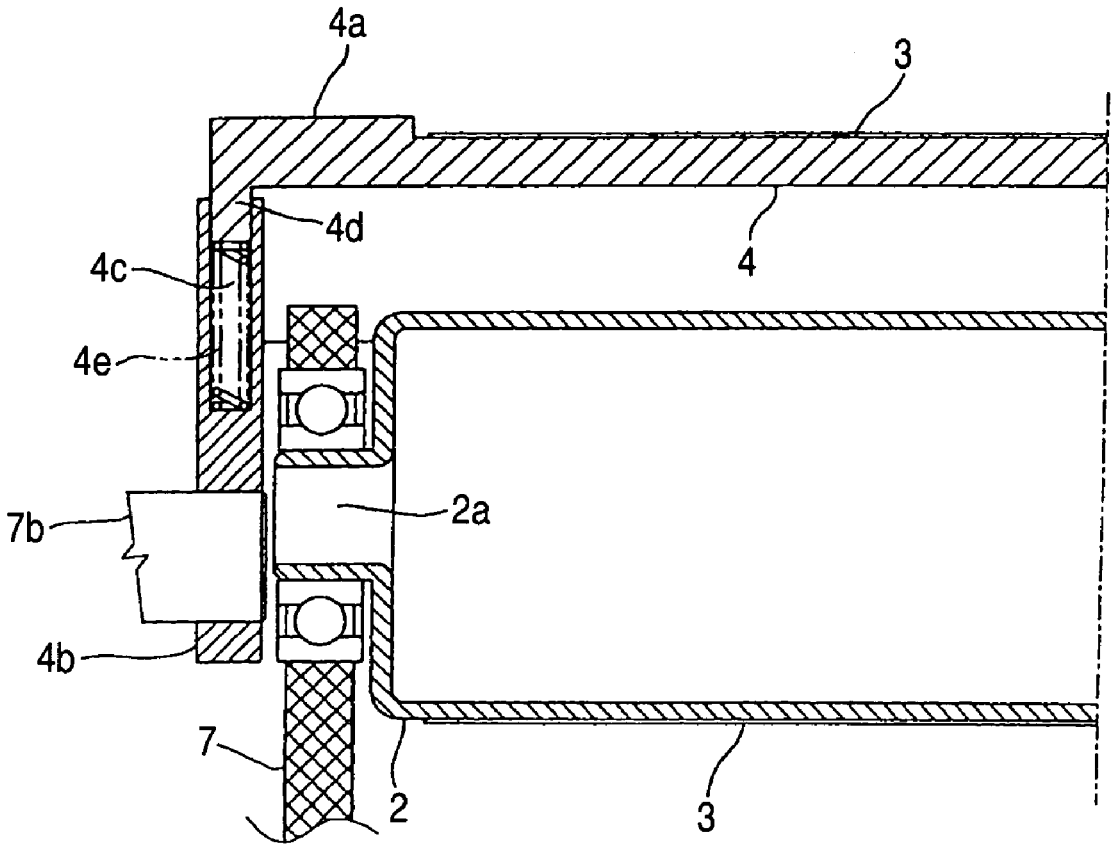
FIG. 15B is a section view taken along a line XVB—XVB in FIG. 1 SA.

FIGS. 15A and 15B show a fifth embodiment of the invention. Elements similar to those in the first embodiment will be designated by the same reference numerals and the repetitive explanations for those will be omitted.

In this embodiment, the belt stretcher 4 is pivotably supported on a shaft 7*b* which is different from the rotary shaft 2*a* of the press roller 2. Specifically, the pivot arm 4*b* of the belt stretcher 4 is pivotably fitted with the shaft 7*b* placed at a different position from the rotary shaft 2*a*.

With this configuration, it is possible to change an angular moment acting on the belt stretcher 4 (an angular moment is increased in this embodiment in comparison with the first embodiment) and to adjust a pressure provided from the belt 3 against the heating roller 1.

In the above embodiments, one of the heating roller 1 and the press roller 2 serves as a driving roller, while the other one serves as a follower roller. Since it is preferable that a roller having a harder surface serves as a driving roller in order to stabilize the conveyance speed of the sheet medium 5, the press roller 2 serves as the driving roller, while the heating roller 1 serves as the follower roller.

In the above embodiments, a mechanism for selecting the rotary speed of the heating roller 1 and the prose roller 2 may be adopted. For example, one of two rotary speeds may be selected in accordance with the property (kind) of the sheet medium to be conveyed. In order to effect the speed selection, there are provided a detector for detecting the property (kind) of the sheet medium during the conveyance, and setting means for providing selecting information items associated with the detected property (kind) of the sheet medium are provided in advance. The selecting information item may be provided by manually actuating an element interlocking with the fixing device prior to the fixing command, or may be provided as an electric signal to remotely control such an element.

For example, the slower rotary speed is selected when a thick sheet medium having a large heat capacity such as an envelope or a transparent sheet medium such as an OHP sheet is subjected to the fixing operation, because it is necessary a longer time period for sufficiently fusing an unfixed toner image 5*a* on such a sheet medium 5.

Since it is configured to eliminate drastic change of the stress applied to the sheet medium 5 during the passage through the fixing nip portion as described the above, the deformation of the sheet medium such as wrinkles can be avoided even if the slower rotary speed (conveyance speed) is selected.

Figure 16:
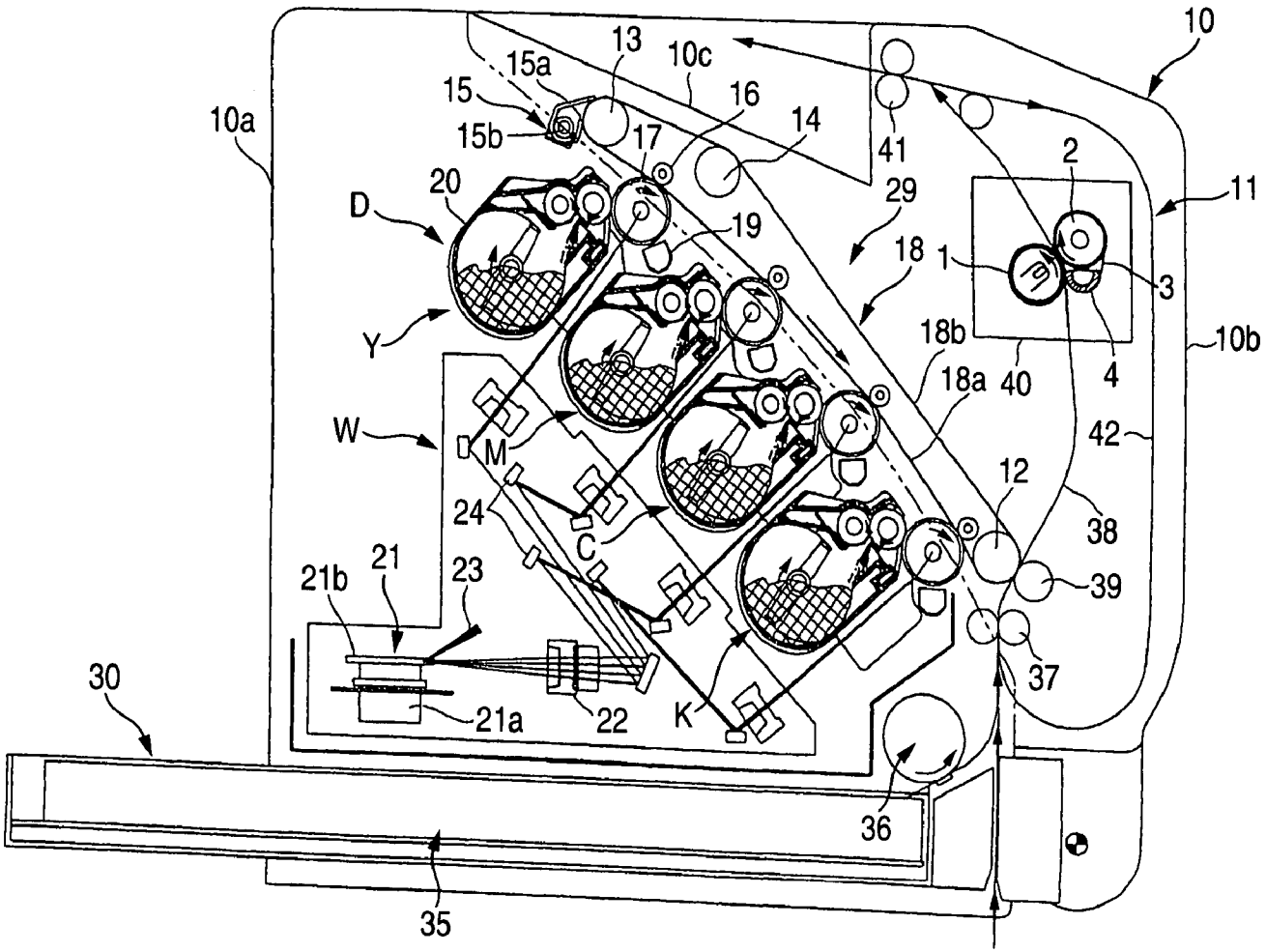
FIG. 16 is a schematic section view showing an image forming apparatus incorporating the fixing device of the invention.

An image forming apparatus incorporating the fixing device as described above will now be described with reference to FIG. 16. In the figure, reference numeral 10 represents an image forming apparatus.

The image forming apparatus 10 has a housing 10*a*, a sheet output tray 10*c* formed on the top of the housing 10*a*, and a door 10*b* openably mounted on a front face of the housing 10*a*. An exposure unit W, an image forming unit D, a transfer belt unit 29 including an image transporter 18, and a sheet supply unit 30 are disposed in the housing 10*a*, while a sheet conveyor unit 11 is disposed in the dour 10*b*. Each of the units is configured to be attachable and detachable to and from the main body and is configured, such that it can be removed as an integral body to be repaired or replaced at the time of maintenance.

The image forming unit D has image forming stations Y (for yellow), M, (for magenta), C (for cyan), and K (fur black) for forming images in a plurality of colors (four colors in this embodiment). Each of the image forming stations Y, M, C, and K has an image supporter 17 constituted by a photosensitive drum, a charging unit 19 constituted by a corona charger disposed around the image supporter 17, and the developing unit 20. The image forming stations Y, M, C, and K are arranged side by side along a diagonal arched line under the transfer belt unit 29 with their image supporters 17 facing upward. The image forming stations Y, M, C, and K may be arranged in an arbitrary order.

The transfer belt unit 29 comprises: a driving roller 12 disposed in a lower part of the housing 10*a* and rotated by a driving source which is not shown; a driven roller 13 disposed diagonally above the driving roller 12; a tension roller 14; the image transporter 18 which is constituted by an intermediate transfer belt stretched between the three rollers or at least two of them and driven for circulation in the direction of the arrow in the figure; and a cleaning unit 15 which is in contact with a surface of the image transporter 18. The driven roller 13, the tension roller 14, and the image transporter 18, are disposed in a direction that is inclined to the left of the driving roller 12 in the figure. As a result, a belt surface 18*a* of the image transporter 18 to be moved in a downward direction is positioned lower, and a belt surface 18*b* of the image transporter 18 to be moved in an upward-direction-is-positioned higher.

Therefore, the image forming stations Y, M, C, and K are also disposed in a direction that is inclined to the left of the driving roller 12 in the figure. The image supporters 17 are put in contact with the belt surface 18*a* of the image transporter 18 and rotated in the direction indicated by arrows in the figure. The image transporter 18 that is in the form of a flexible endless sleeve is put in contact with the image supporters 17 at substantially the same winding angle so as to cover them from above. Therefore, the contact pressures and nip widths between the image supporters 17 and the image transporter 18 can be adjusted by controlling the tension applied to the image transporter 18 by the tension roller 14, the intervals at which the image supporters 17 are provided, and the winding angles (the curvature of the arch).

The driving roller 12 also serves as a backup roller for a secondary transfer roller 39. For example, a rubber layer having a thickness of about 3 mm and a volume resistivity of $10^5\Omega\cdot$cm or less is formed on a circumferential surface of the driving roller 12 and is grounded through a shift made of metal to provide a conductive path for a secondary transfer bias supplied through the secondary transfer roller 39. By providing such a rubber layer having high friction and shock absorbing properties on the driving roller 12, any shock occurring when a sheet material enters the secondary transfer portion can be made less apt to be transmitted to the image transporter 18, and this makes it possible to prevent deterioration at image quality. By providing the driving roller 12 with a diameter smaller than those of the driven roller 13 and the tension roller 14, a sheet material which has been subjected to secondary transfer is allowed to be easily separated by an elastic force of the sheet material itself. Further, the driven roller 13 is also used as a backup roller for the cleaning unit 15 which will be described later.

The image transporter 18 may be disposed in a direction that is inclined to the right of the driving roller 12 in the figure, and the image forming stations Y, M, C, and K may be also disposed in the form of a diagonal arch in a direction that is inclined to the right of the driving roller 12, accordingly.

The cleaning unit 15 comprises: a cleaning blade 15*a* which is provided on the side of the belt surface 18*a* to remove any toner left on the surface of the image transporter 18 after the secondary transfer, and a toner conveyer 15*b* for conveying the collected toner. The cleaning blade 15*a* abuts on the image transporter 18 in the region where the image transporter 18 is wound around the driven roller 13. Primary transfer members 16 abut on the back surface of the image transporter 18 opposite to the image supporters 17 of the image forming stations Y, M, C, and K which will be described later, and a transfer bias is applied to the primary transfer members 16.

The exposure unit W is disposed in a space formed diagonally below the image forming unit D which is diagonally disposed. The sheet supply unit 30 is disposed at the bottom of the housing 10*a* under the exposure unit W. The exposure unit W as a whole is contained in a case, and the case is disposed in a space formed diagonally below the belt surface which is transported in a downward direction. A single scanner unit 21 comprising a polygon mirror motor 21*a* and a rotatable polygon mirror 21*b* is horizontally disposed at the bottom of the case. In an optical system β in which laser beams from a plurality of laser light sources 23 modulated by image signals in respective colors are reflected at the polygon mirror 21*b* to deflect and scan them on the image supporters 17, there is disposed a single f-θ lens 22 and a plurality of reflecting mirrors 24 for folding the paths of the scanning beams in the respective colors toward the image supporters in non-parallel with each other.

In the exposure unit W having the above-described configuration, image signals associated with respective colors exit the polygon mirror 21*b* in the form of laser beams modulated and formed based on a common date clock frequency, and the laser beams travel through the f-θ lens 22 and the reflecting mirror 24 and impinge upon the image supporters 17 of the image forming stations Y, M, C, and K to form latent images. The paths of the scanning beams are deflected by providing the reflecting mirror 24, which makes it possible to reduce the height of the case and to thereby make the optical system compact. In addition, the reflecting mirror 24 is provided to equalize the scanning optical path lengths up to the image supporters of the image funning stations Y, M, C, and K.

In such a configuration, the scanning widths of the optical beams scanned through the respective optical paths are substantially the same, which eliminates a need for any special configuration for the formation of image signals. Therefore, the laser light sources can be modulated based on a common data clock frequency, although they are modulated by different image signals in association with images in different colors. Since a common reflecting surface is used, color deviations attributable to relative differences in the sub-scanning direction. It is therefore possible to configure a color image forming apparatus having a simple structure at a low cost.

The scanning optical system is provided in a lower part of the apparatus, which makes it possible to minimize vibration of the scanning optical system due to vibration imparted to the frame supporting the apparatus from the driving system of the image forming unit, thereby preventing any deterioration in image quality. In particular, by providing the scanner unit 21 at the bottom of the case, vibration imparted to the case as a whole by the polygon motor 21*a* itself can be minimized to prevent any deterioration in image quality. Further, vibration imparted to the case as a whole can be minimized by providing only one polygon motor 21*a* that is a source of vibration.

The sheet supply unit 30 has a street supply cassette 35 and a pickup roller 36 for feeding sheet materials from the sheet supply cassette 35 one sheet at a time. The sheet conveyer unit 11 comprises: a pair or gate rollers 37 (one of the rollers is provided on the housing 10*a*) for regulating timing at which the sheet materials are supplied to the secondary transfer portion; the secondary transfer roller 39 which is pressed against the driving roller 12 and the image transporter 18; a main transport path 38; a fixing unit 50; a pair of sheet ejection rollers 41; and a transport path 42 for double-side printing.

A secondary image (unfixed toner image) formed on a sheet material as a result of secondary transfer is fixed at a predetermined temperature in a nip portion formed by the fixing unit 50. The fixing unit 50 can be disposed in a space formed diagonally above the upwardly transported belt surface 18*b* or the image transporter 18. In other words, a space on the side of the transfer belt opposite to the image forming stations, which makes it possible to reduce heat transmission to the exposure unit W, the image transporter 18, and the image forming unit D and to reduce the frequency of color deviation correcting operations for each color. In particular, the exposure unit W is positioned furthest from the fixing unit 50, and displacement of components of the scanning optical system of the same attributable to heat can be minimized to prevent color deviation.

Since the image transporter 18 is disposed in a direction that is inclined relative to the driving roller 12, a large space is left in a position on the right side of FIG. 11, and the fixing unit 50 can be disposed in that space. It is therefore possible to downside the apparatus and to prevent heat generated by the fixing unit 50 from being transmitted to the exposure unit W, the image transporter 18, and the d image forming stations Y, M, C, and K which are located on the left side. Further, since the exposure unit W can be disposed in a space located below and to the left of the image forming unit D, it is possible to minimize vibration of the scanning optical system of the exposure unit W attributable to vibration of the housing 10*a* imparted by the driving system of tire image forming unit and to thereby prevent any deterioration in image quality.

Since no cleaning unit for the charging unit 19 is provided, the corona charger is employed. In a case where the charger is provided as a roller member, toner remains on the image supporters 17 after the primary transfer although in a very small amount, and it accumulates on the roller to cause a charging failure. Toner is less apt to stick to the corona charger which is a non-contact type charger, and the occurrence of a charging failure can therefore be prevented.

This apparatus employs a configuration in which an intermediate transfer belt is used as the image transporter 18 which is put in contact with the image supporters 17. Alternatively, a configuration may be employed in which a belt conveying a sheet material is used as the image transporter 18 which is put in contact with the image supporters 17. In this case, toner images are sequentially transferred on a sheet material adhered on the belt member in a superposed manner. Incidentally, the circulating direction of the belt member is upward at a lower surface thereof that is in contact with the image supporters 17.

Next, the movement of the sheet medium 5 guided by the guide member 8 will be described with reference to FIGS. 17A to 18B. The configuration of the first embodiment is exemplified.

Even if the sheet medium 5 is ejected from the fixing nip portion without being wound around the heating roller 1, the sheet medium 5 is liable to be curled and directed toward either the heating roller 1 or the press roller 2 due to various factors such as a moist state, a state of sheet fiber, a constituent material, sheet quality, a sheet thickness an amount of toner on the sheet medium (kind of an image formed on the sheet medium), and toner amount difference between both surfaces of the sheet medium.

Figure 17A:
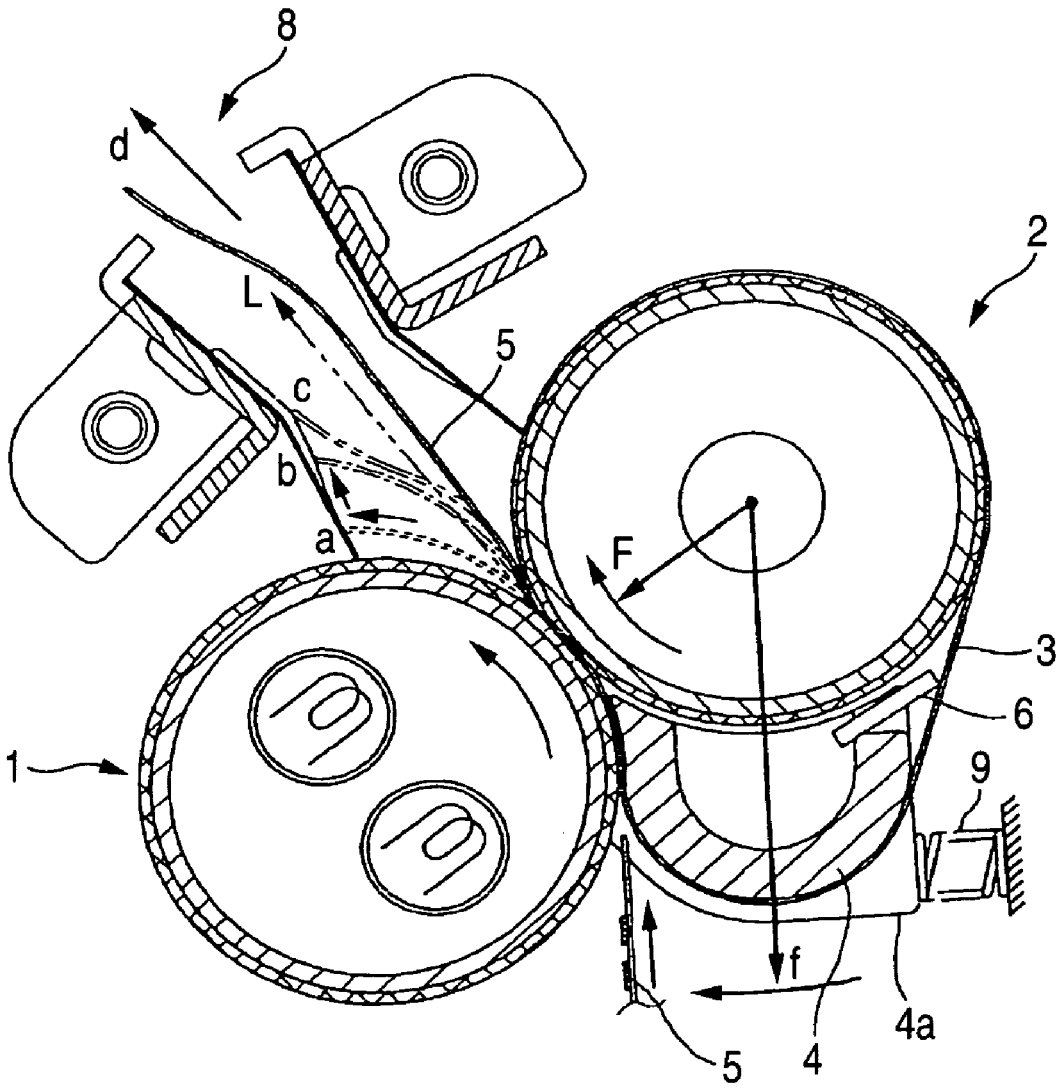
FIGS. 17A and 17B are schematic section view for explaining the function of the guide member in the fixing device of FIG. 1 showing a case where the sheet medium ejected from the fixing nip portion is curled toward the heating roller.
Figure 17B:
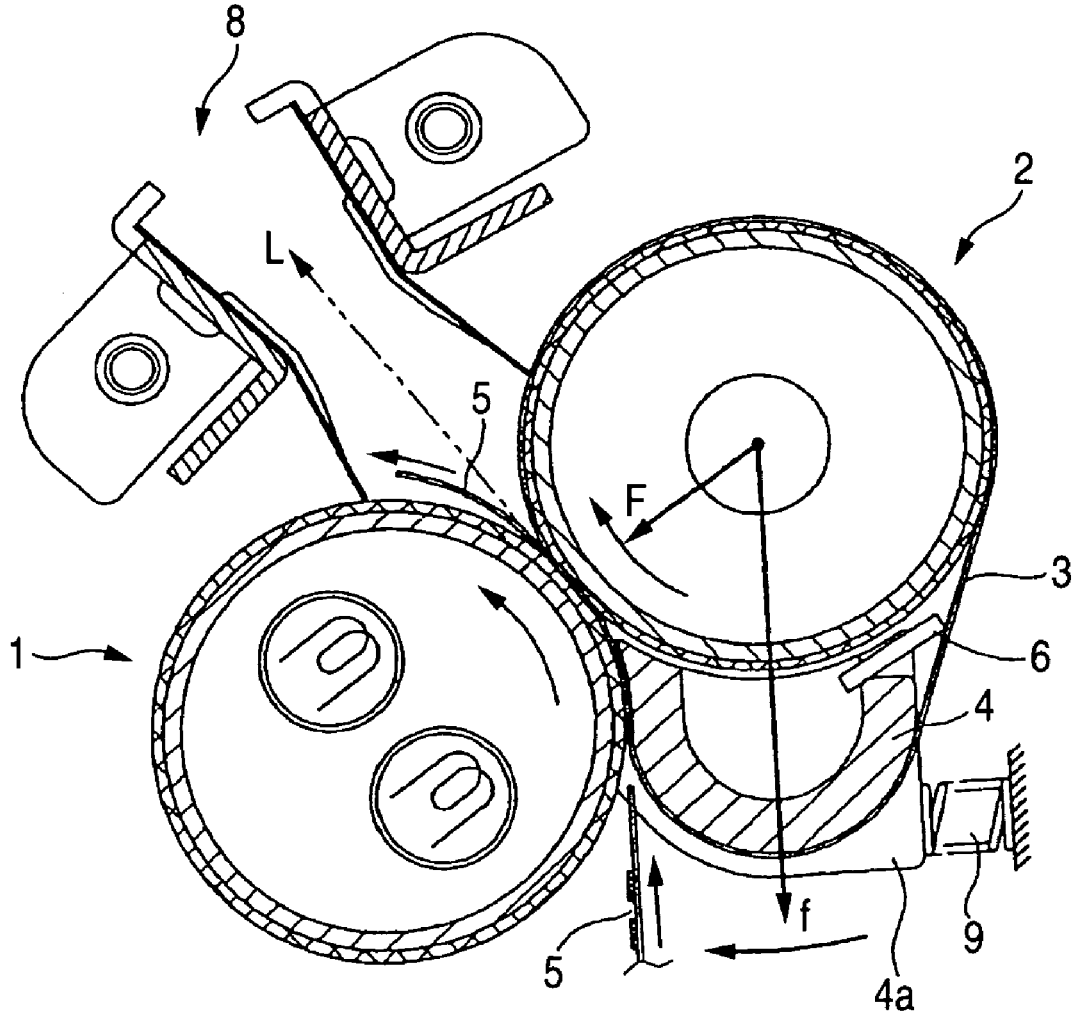

In a case where the sheet medium 5 ejected from the fixing nip portion is curled toward the heating roller 1 relative to the tangential line L as shown in FIG. 17B, the leading end of the sheet medium 5 first comes in contact with the guide slope 8*c* (a in FIG. 17A). The sheet medium 5 is kept being conveyed while the leading end slides on the guide slope 8*c* (b in FIG. 17A). This slide movement gives a reaction force to the shoot medium 6 so as to curl it in the opposite direction (c in FIG. 17A). As a result, the sheet medium 5 is guided in a direction almost along with the tangential line L (d in. FIG. 17A). Since only the leading end portion of the sheet medium 5 is brought into contact with the guide member 8, that is, the toner image fixed on the sheet medium 5 is not brought into contact with the guide member 8, the transfer or adhesion of the toner image onto the guide member 8 can be reliably avoided.

Figure 18A:
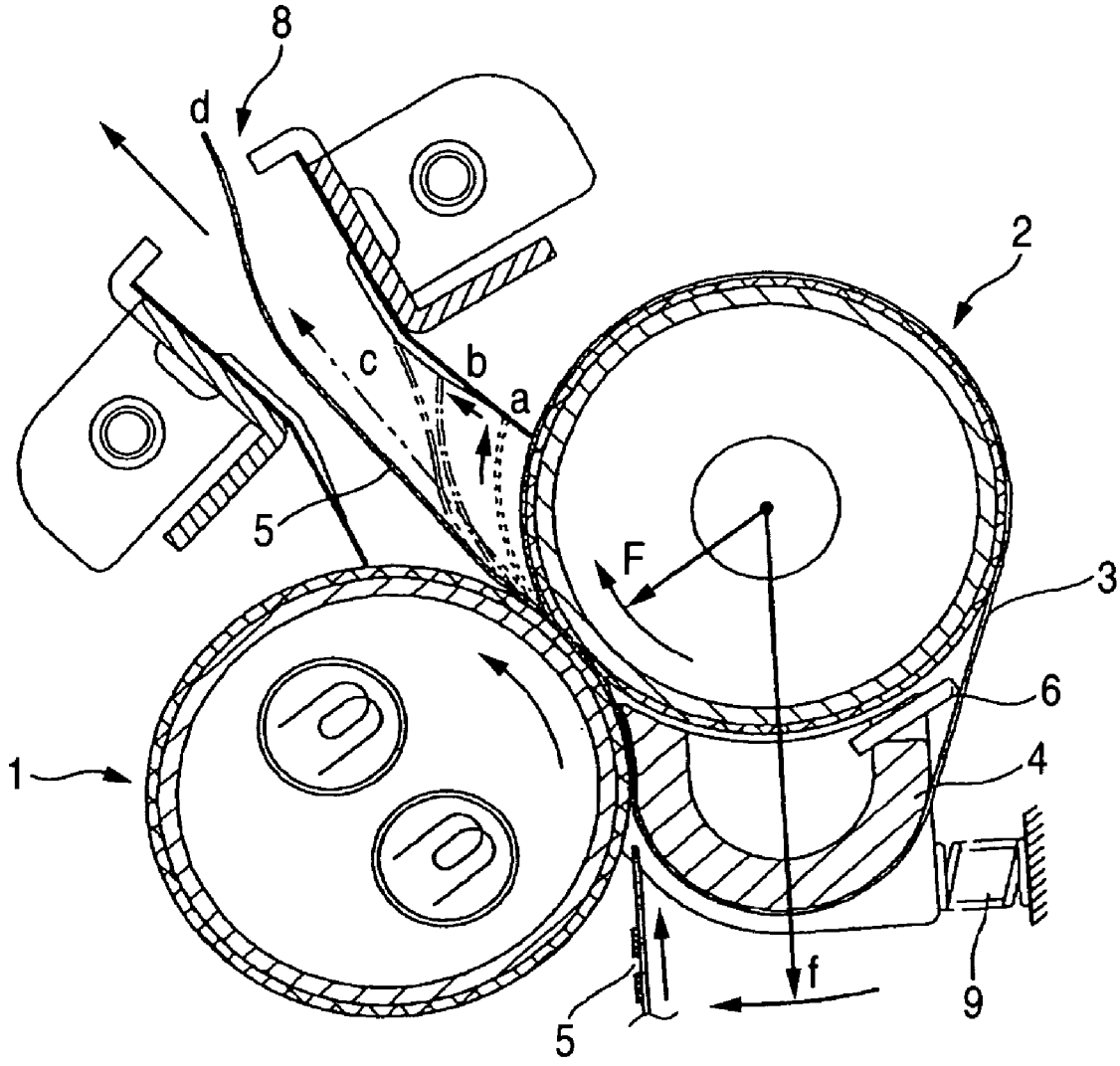
FIGS. 18A and 18B are schematic section view for explaining the function of the guide member in the fixing device of FIG. 1, showing a case where the sheet medium ejected from the fixing nip portion is curled toward the press roller.
Figure 18B:
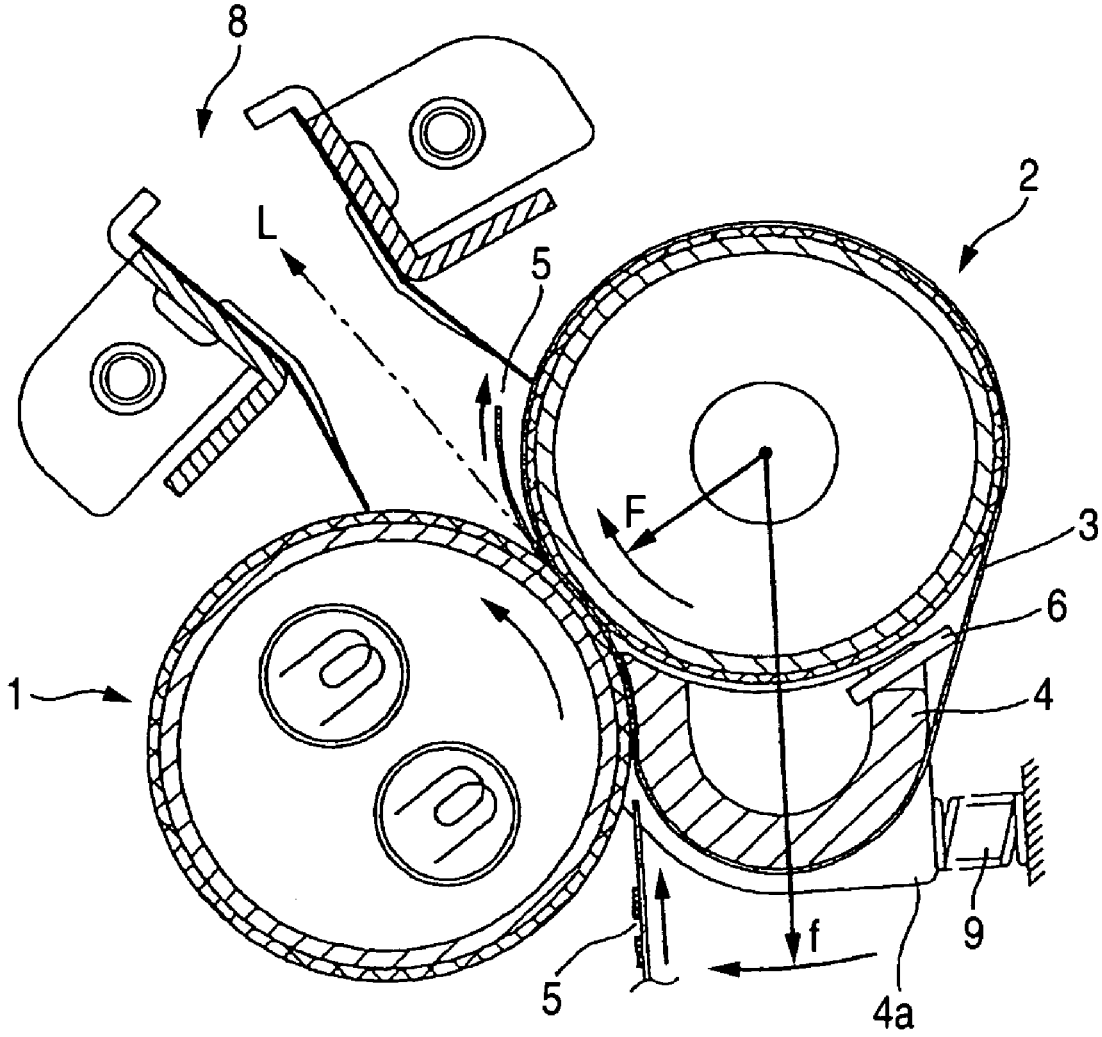

In a case where the sheet medium 5 ejected from the fixing nip portion is curled toward the press roller 2 relative to the tangential line L as shown in FIG. 18B, the leading end of the sheet medium 5 first comes in contact with the guide slope 8*c* (a in FIG. 18A). The sheet medium 5 is kept being conveyed while the leading end slides on the guide slope 8*c* (b in FIG. 18A). This slide movement gives a reaction force to the sheet medium 5 so as to curl it in the opposite direction (c in FIG. 18A). As a result, the sheet medium 5 is guided in a direction almost along with the tangential line L (d in FIG. 18A). Since only the leading end portion of the sheet medium 5 is brought into contact with the guide member 8, that is, the toner image fixed on the sheet medium 5 is not brought into contact with the guide member 8, the transfer or adhesion of the toner image onto the guide member 8 can be reliably avoided.

Figure 19:
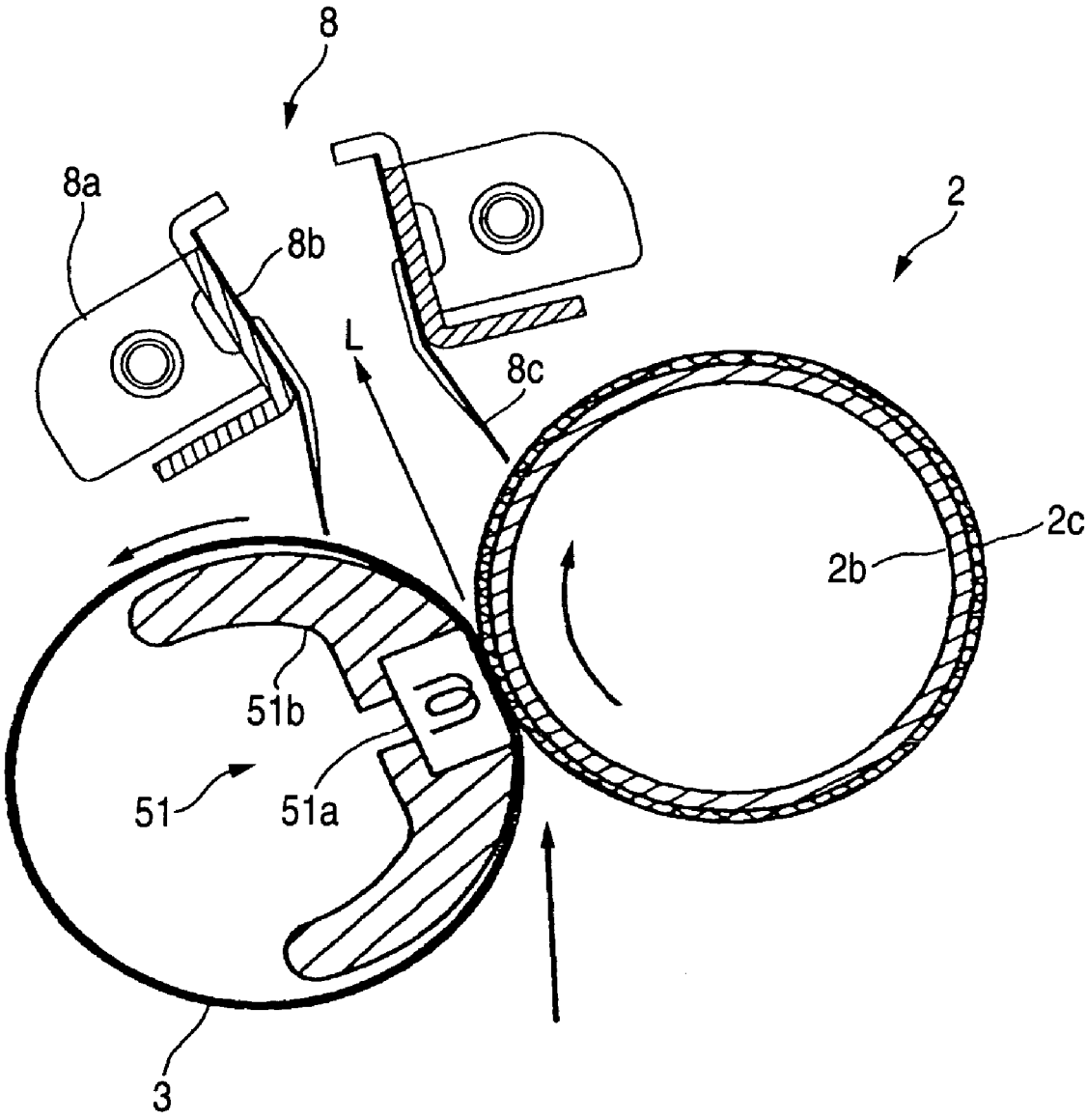
FIG. 19 is a schematic section view of a fixing device according to a sixth embodiment of the invention.

FIG. 19 shows a sixth embodiment of the invention. Elements similar to those in the first embodiment will be designated by the same reference numerals and the repetitive explanations for those will be omitted.

In this embodiment, the fixing device comprises a thermal fixing member 51 instead of the heating roller 1. The thermal fixing member 51 comprises a heating element 51*a* having a flat heating surface, and a belt guide member 51*b* for supporting the heating element 51*a*. The belt guide member 51*b* is made of ceramics for example. The heat-resistant belt 3 is circulated while being brought into slide contact with the heating surface of the heating element 51*a*. The press roller 2 is opposed to the heating element 51*a* to provide pressure against the heating surface of the heating element 51*a* through the belt 3, thereby forming a fixing nip portion. The combination of the materials for the heating element 51*a*, the press roller 2 and the belt 3 is selected such that the friction coefficient between the press roller 2 and the belt 3 is made large, while the friction coefficient between the heating element 51*a* and the belt 3 is made small. The belt stretcher 4 is omitted.

When the belt 3 is pressed against the heating element 51*a* by the press roller 2, since the surface of the press roller 2 is provided with the elastic layer 2*c*, the belt 3 can be brought into close contact with the flat heating surface of the heating element 51*a*, so that a flat fixing nip portion is formed.

Since the shoot medium 5 passes through the fixing nip portion which is made flat the sheet medium 5 ejected from the fixing nip portion would be hardly wound around the press roller 2 or the belt 3, thereby dispensing with such a peeler which forcibly peels off the sheet medium 5.

Even if the sheet medium 5 is ejected from the fixing nip portion without being wound around the belt 3, the sheet medium 5 is liable to be curled and directed toward either the heating roller 1 or the press roller 2 due to various factors such as a moist state, a state of sheet fiber, a constituent material, sheet quality, a sheet thickness, an amount of toner on the sheet medium (kind of an image formed on the sheet medium), and toner amount difference between both surfaces of the sheet medium.

Figure 20:
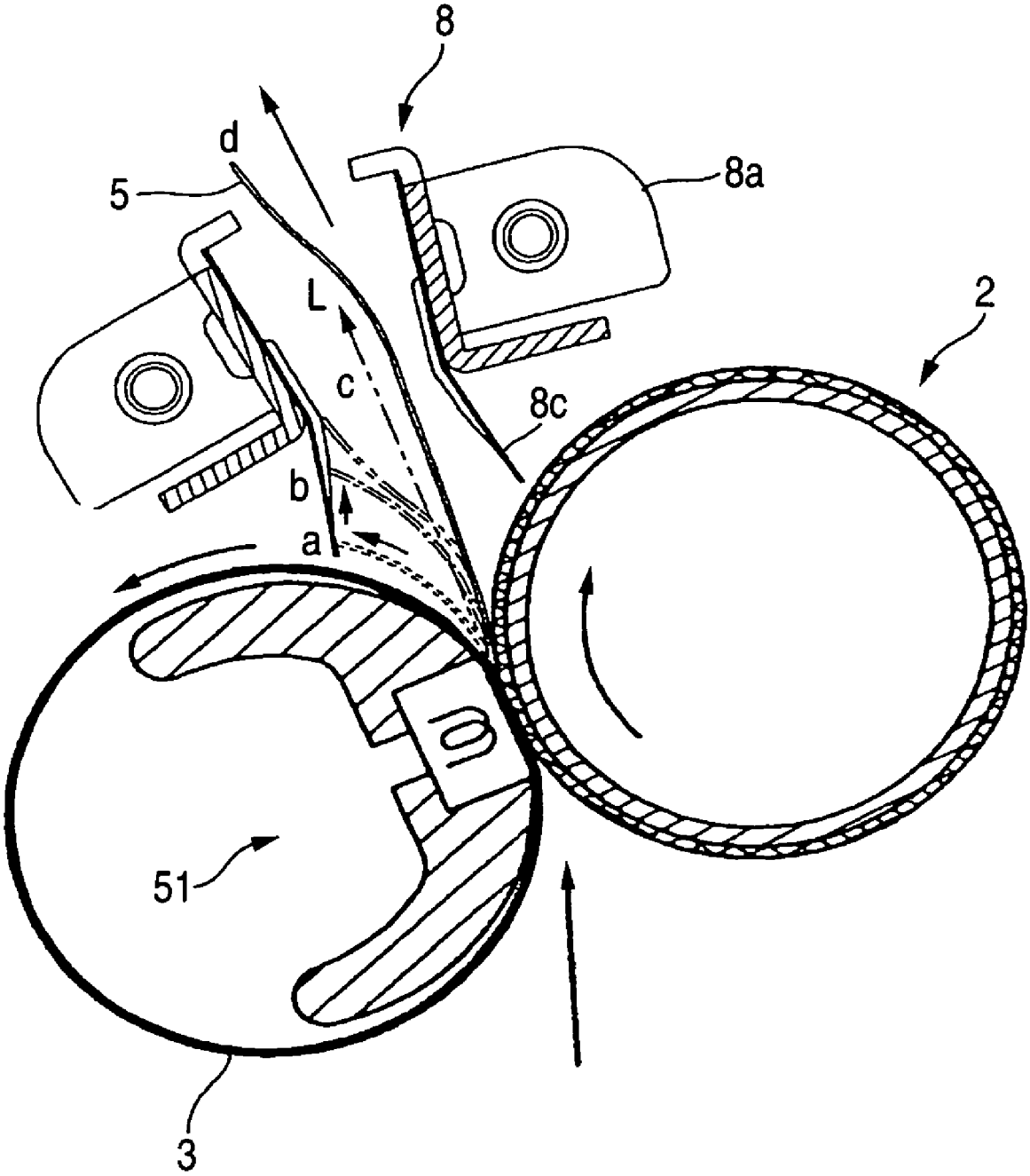
FIG. 20 is a schematic section view for explaining the function of the guide member in the fixing device of FIG. 19, showing a case whore the sheet medium ejected from the fixing nip portion is curled toward the heating element.

In a case where the sheet medium 6 ejected from the fixing nip portion is curled toward the belt 3 relative to the tangential line L as shown in FIG. 20, the leading end of the sheet medium 5 first comes in contact with the guide slope 8*c* (a in FIG. 20). The sheet medium 5 is kept being conveyed while the leading end slides oh the guide slope 8*c* (b in FIG. 20). This slide movement gives a reaction force to the sheet medium 5 so as to curl it in the opposite direction (c in FIG. 20). As a result, the sheet medium 5 is guided in a direction almost along with the tangential line L (d in FIG. 20). Since only the leading end portion of the sheet medium 5 is brought into contact with the guide member 8, that is, the toner image fixed on the sheet medium 6 is not brought into contact with the guide member 8, the transfer or adhesion of the toner image onto the guide member 8 can be reliably avoided.

Figure 21:
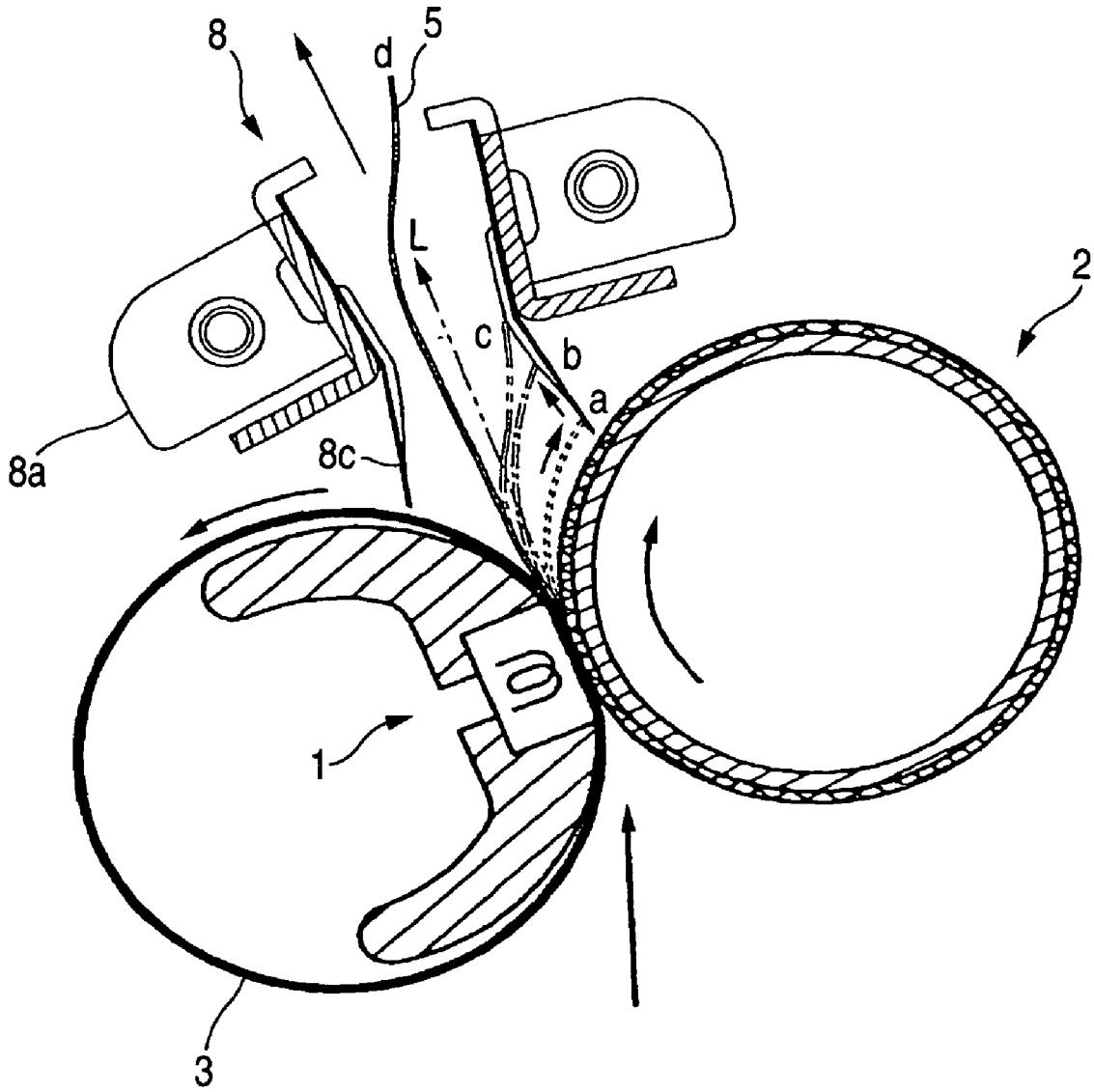
FIG. 21 is a schematic section view for explaining the function of the guide member in the fixing device of FIG. 19, showing a case where the sheet medium ejected from the fixing nip portion is curled toward the press roller.

In a case where the sheet medium 5 ejected from the fixing nip portion is curled toward the press roller 2 relative to the tangential line L as shown in FIG. 21, the leading and of the sheet medium 5 first comes in contact with the guide slope 8*c* (a in FIG. 21). The sheet medium 5 is kept being conveyed while the leading end slides on the guide slope 8*c* (b in FIG. 21). This slide movement gives a reaction force to the sheet medium 5 so as to curl it in the opposite direction (c in FIG. 21). As a result, the sheet medium 5 is guided in a direction almost along with the tangential line L (d in FIG. 21). Since only the leading end portion of the sheet medium 5 is brought into contact with the guide member 8, that is, the toner image fixed on the sheet medium 5 is not brought into contact with the guide member 8, the transfer or adhesion of the toner image onto the guide member 8 can be reliably avoided.

Figure 22A:
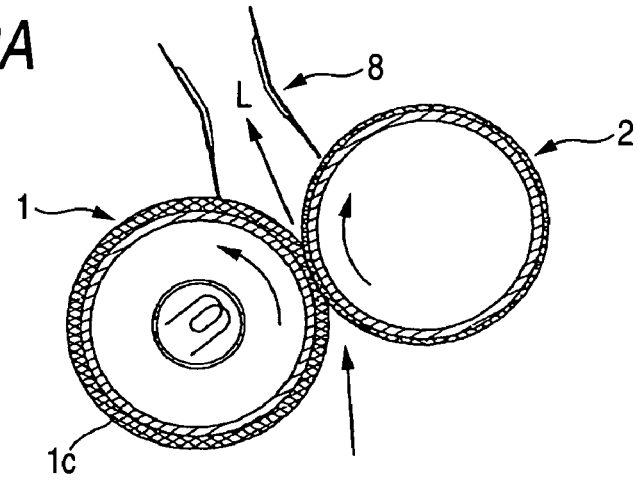
FIG. 22A is a schematic section view of a fixing device according to a seventh embodiment of the invention.

FIG. 22A shows a seventh embodiment of the invention. Elements similar to those in the fist embodiment will be designated by the same reference numerals and the repetitive explanations for those will be omitted.

In this embodiment, the belt 3 and the belt stretcher 4 are omitted. The fixing nip portion is formed by the press contact between the heating roller 1 and the press roller 2.

Figure 22B:
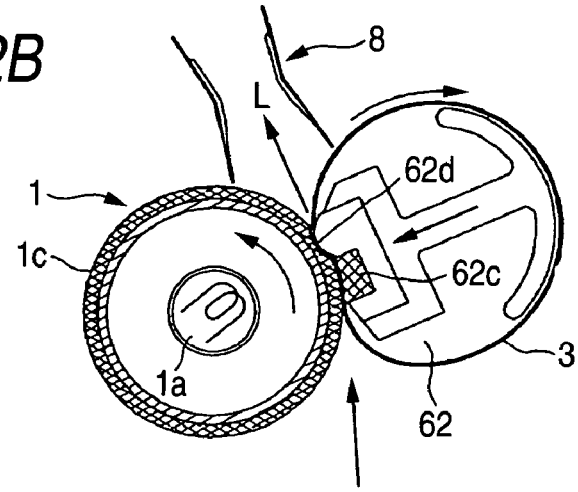
FIG. 22B is a schematic section view of a fixing device according to an eighth embodiment of the invention.

FIG. 22B shows an eighth embodiment of the invention. Elements similar to those in the first embodiment will be designated by the same reference numerals and the repetitive explanations for those will be omitted.

In this embodiment, a press member 62 is provided instead of the press roller 2. The press member 62 comprises an elastic member 62*c* which presses the belt 3 against the heating roller 1 to form a wide fixing nip portion, and a separator 62*d* having a curvature radius smaller than that of an outer periphery of the heating roller 1 to locally deform the elastic surface layer 1C of the heating roller 1, thereby enhancing the peelablilty of the sheet medium 5 from the heating roller 1. As a result, the sheet medium 5 ejected from the fixing nip portion would be hardly wound around the heating roller 1 or the belt 3, thereby dispensing with such a peeler which forcibly peels off the shoot medium 5.

Figure 22C:
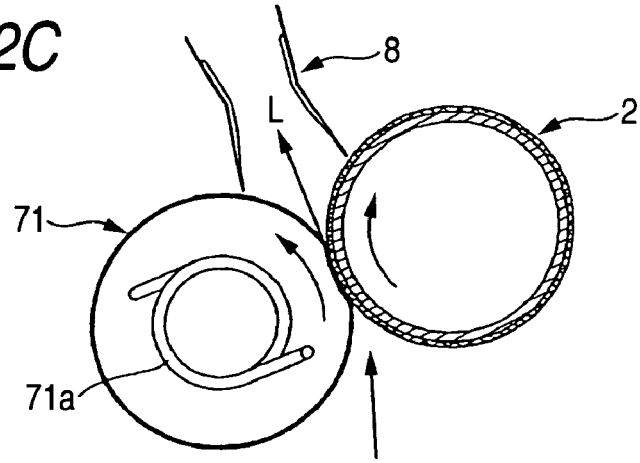
FIG. 22C is a schematic section view of a fixing device according to a ninth embodiment of the invention.

FIG. 22C shows a ninth embodiment of the invention. Elements similar to those in the first embodiment will be designated by the same reference numerals and the repetitive explanations for those will be omitted.

In this embodiment, a metallic heating belt 71 is provided instead of the heating roller 1. The heating belt 71 generates heat upon application of high-frequency current to a coil 71*a*. The press roller 2 is brought into press contact with the heating belt 71 to farm a fixing nip portion. The heating belt 71 comprises a substrate composed of a metallic member such as a thin-sheet SUS pipe, nickel electrocast pipe, etc., a heat-resistant elastic layer, such as silicone rubber, etc., formed on a surface of the substrate, and a PFA surface layer provided on the heat-resistant elastic layer to be able to be elastically deformed together with the metallic substrate.

Since the surface of the press roller 2 is made harder than the surface of the heating belt 71, the heating belt 71 is recessed at the fixing nip portion. With this configuration, the sheet medium 5 is curled in such a direction separating from the heating belt 71 at the exit of the fixing nip portion, so that the sheet medium 5 ejected from the fixing nip portion is conveyed without winding on the heating belt 71.

Figure 22D:
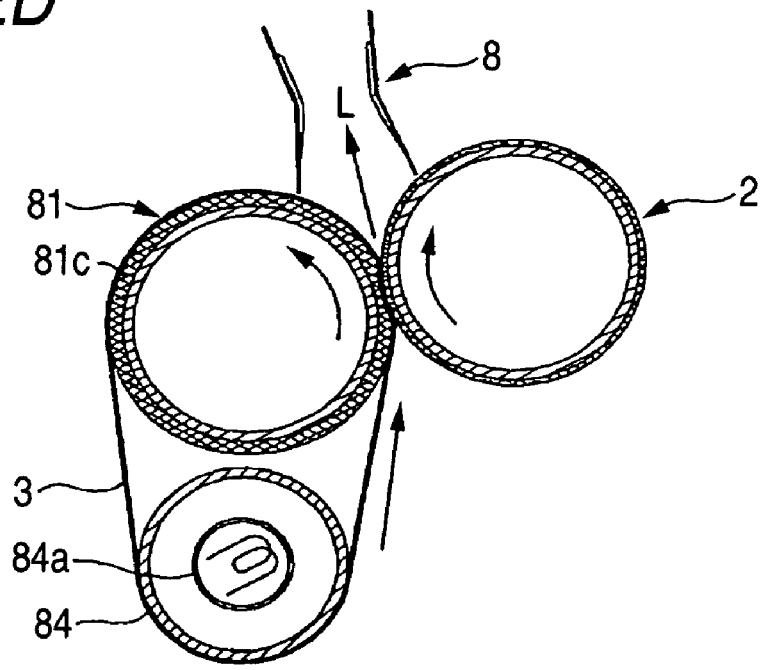
FIG. 22D is a schematic section view of a fixing device according to a tenth embodiment of the invention.

FIG. 22D shows a tenth embodiment, of the invention. Elements similar to those in the first embodiment will be designated by the same reference numerals and the repetitive explanations for those will be omitted.

In this embodiment, the belt 3 is stretched by a fixing roller 81 and a heating roller 84 provided with a heat source 84*a*. The press roller 2 is arranged so as to press the belt 3 against the fixing roller 81, thereby forming a fixing nip portion. Since the surface of the press roller 2 is made harder than an elastic surface layer 81*c* of the fixing roller 81, the elastic surface layer 81*c* is recessed at the fixing nip portion. With this configuration, the sheet medium 5 is curled in such a direction separating from the fixing roller 81 at the exit of the fixing nip portion, so that the sheet medium 5 ejected from the fixing nip portion is conveyed without winding on the belt 3.

Figure 22E:
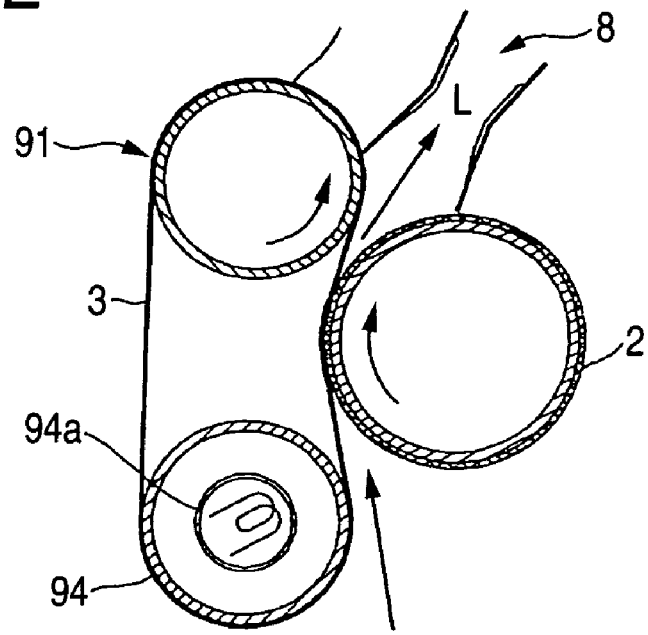
FIG. 22E is a schematic section view of a fixing device according to an eleventh embodiment of the invention.

FIG. 22E shows an eleventh embodiment of the invention. Elements similar to those in the first embodiment will be designated by the same reference numerals and the repetitive explanations for those will be omitted.

In this embodiment, the belt 3 is stretched by a roller 91 and a heating roller 94 provided with a heat source 94*a*. The press roller 2 is brought into press contact with the belt 3 at a position between the roller 91 and the heating roller 94, thereby forming a fixing nip portion. Since the belt 3 is recessed from the tangential line at the press contact position between the belt 3 and the press roller 2, the sheet medium 5 is curled in such a direction separating from the fixing roller 91 at the exit of the fixing nip portion, so that the sheet medium 5 ejected from the fixing nip portion it conveyed without winding on the belt 3.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

For example, in the above embodiments, the slant angle of the guide slope 8*c* in the guide member 8 is made constant. However, the slant angle may be suitably changed so that the guide slope 8*c* is curved relative to the tangential line L. Further, in the above embodiments, a pair of the guide members 8 are symmetrically arranged with respect to the tangential line L. However, the guide member 8 may be single or the guide members 8 may be arranged asymmetrically in accordance with the configuration of the image forming apparatus.

What is claimed is:

1. A fixing device for fixing a toner image onto a recording medium, comprising;

a heating roller, comprising:

a heat source; and an elastic layer, provided on an outer periphery thereof;

an endless belt, adapted to be circulated;

a press member, which presses a part of the endless belt against the heating roller so as to deform the elastic layer, thereby forming a fixing nip portion through which the recording medium is passed; and a guide member, having a slope portion extended so as to close to a tangential line defined at a press contact position between the heating roller and the press member as is being away from the exit of the fixing nip portion, wherein a fixing pressure generated at the fixing nip portion is continuously increased from an entrance of the fixing nip portion to the exit of the fixing nip portion.

2. The fixing device as set forth in claim 1, wherein the press member comprises:

a press roller, opposed to the press contact position; and a belt stretcher, disposed on an upstream side in a conveyance direction of the recording sheet relative to the press roller, to stretch the bolt together with the press roller while pressing a part of the belt against the heating roller to form the entrance of the fixing nip portion.

3. The fixing device as set forth in claim 1, wherein the press member comprises:

an elastic member, which presses the belt against the heating roller so as to form at least the entrance of the fixing nip portion; and a separator, formed with a surface having a curvature radius which is smaller than a curvature radius of the outer periphery of the heating roller, the separator pressing the belt against the heating roller so as to form at least the exit of the fixing nip portion.

4. The fixing device as set forth in claim 1, wherein at least a part of the press member forming the fixing nip portion is harder than the elastic layer of the heating roller.

5. The fixing device as set forth in claim 1, wherein a PEA layer is formed on a surface of the elastic layer of the heating roller.

6. The fixing device as set forth in claim 1 wherein the fixing pressure is continuously increased from the entrance to the exit of the fixing nip portion.

7. The fixing device as set forth in claim 1, wherein the guide member is provided as a plate member including the slope portion.

8. The fixing device as set forth in claim 1, wherein a plurality of ribs are provided on the slope portion so as to extend in a conveyance direction of the recording medium.

9. The fixing device as set forth in claim 1, wherein at toast a part of the guide member to be faced with the recording medium is coated with lubricant.

10. The fixing device as set forth in claim 1, wherein the slope portion is disposed in the vicinity of an exit of the fixing nip portion with a gap in between.

11. An image forming apparatus, comprising:

an image forming section, which forms a toner image on a recording medium; and the fixing device as set forth in claim 1, which fixes the toner image on the recording medium.

* * * * *